US012781489B2

(12) United States Patent
Nagata et al.

(10) Patent No.: US 12,781,489 B2
(45) Date of Patent: Nov. 3, 2026

(54) SANITARY WASHING DEVICE

(71) Applicant: TOTO LTD., Kitakyushu (JP)

(72) Inventors: Katsuya Nagata, Kitakyushu (JP); Junki Hamada, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 196 days.

(21) Appl. No.: 18/746,127

(22) Filed: Jun. 18, 2024

(65) Prior Publication Data

US 2025/0109582 A1 Apr. 3, 2025

(30) Foreign Application Priority Data

Sep. 29, 2023 (JP) ..... 2023-169906
Sep. 29, 2023 (JP) ..... 2023-169930

(51) Int. Cl.
*E03D 9/08* (2006.01)

(52) U.S. Cl.
CPC ..... *E03D 9/08* (2013.01)

(58) Field of Classification Search
CPC ..... E03D 9/08; B05B 15/656; B05B 15/74
USPC ... 4/443, 447, 448, 420.3, 420.4, 420.5, 420
See application file for complete search history.

(56) References Cited

U.S. PATENT DOCUMENTS 5,826,282 A * 10/1998 Matsumoto ..... E03D 9/08 4/420.4
5,960,484 A 10/1999 Shao
10,125,482 B2 11/2018 Hashimoto et al.
2003/0106145 A1* 6/2003 Tomita ..... E03D 3/04 4/425
2003/0140406 A1* 7/2003 Miwa ..... E03D 11/02 4/420
2004/0244106 A1* 12/2004 Chesters ..... A61H 35/00 4/620
2008/0047055 A1 2/2008 Lim
2010/0125941 A1* 5/2010 Shin ..... E03D 9/08 4/443
2011/0030133 A1* 2/2011 Morotomi ..... E03D 9/08 4/443
2011/0072570 A1* 3/2011 Morotomi ..... E03D 9/08 4/420.4
2011/0072571 A1* 3/2011 Mochita ..... E03D 9/08 4/443
2011/0203044 A1 8/2011 Lim
2012/0011647 A1* 1/2012 Mochita ..... E03D 9/08 4/443

(Continued)

FOREIGN PATENT DOCUMENTS

CN 202755431 U 2/2013
JP 2001173069 A * 6/2001 ..... B05B 1/26

(Continued)

*Primary Examiner* — Lori L Baker
(74) *Attorney, Agent, or Firm* — McDonald Hopkins LLC

(57) ABSTRACT

A sanitary washing device includes a casing and a nozzle unit. The nozzle unit advances and retreats between the casing and a toilet. The nozzle unit is curved to be upwardly convex and advances and retreats along an arc-like trajectory. The nozzle unit includes a first flow channel through which water flows and a second flow channel connected to the first flow channel. A water flow direction of the second flow channel in a longitudinal direction of the nozzle unit is different from a water flow direction of the first flow channel in the longitudinal direction.

12 Claims, 12 Drawing Sheets

(56) References Cited

U.S. PATENT DOCUMENTS

| | | | | |
|---|---|---|---|---|
| 2012/0124730 | A1* | 5/2012 | Morotomi | E03D 9/08 4/443 |
| 2012/0144574 | A1* | 6/2012 | Morotomi | E03D 9/08 4/443 |
| 2013/0185861 | A1* | 7/2013 | Matsumoto | E03D 9/08 4/443 |
| 2014/0352049 | A1* | 12/2014 | Nakamura | E03D 9/08 4/448 |
| 2016/0215489 | A1 | 7/2016 | Kim et al. | |
| 2020/0056358 | A1 | 2/2020 | Ko et al. | |

FOREIGN PATENT DOCUMENTS

| | | | | | |
|---|---|---|---|---|---|
| JP | 2001-311201 | A | | 11/2001 | |
| JP | 2002-167842 | A | | 6/2002 | |
| JP | 2002-294816 | A | | 10/2002 | |
| JP | 2005-201018 | A | | 7/2005 | |
| JP | 2010-216239 | A | | 9/2010 | |
| JP | 2016-528412 | A | | 9/2016 | |
| JP | 6551717 | B1 | | 7/2019 | |
| JP | 7157904 | B2 | | 10/2022 | |
| KR | 20090072370 | A | * | 7/2009 | E03D 9/002 |
| KR | 20100041572 | A | * | 4/2010 | A47K 13/30 |
| KR | 20100062299 | A | * | 6/2010 | A61L 2/18 |
| KR | 20110044404 | A | * | 4/2011 | A61L 2/18 |
| KR | 10-2021-0071507 | A | | 6/2021 | |
| KR | 102405598 | B1 | * | 6/2022 | B05B 1/16 |
| KR | 102823197 | B1 | * | 6/2025 | G01L 1/005 |
| WO | WO-2023068451 | A1 | * | 4/2023 | B05B 1/26 |

* cited by examiner

SANITARY WASHING DEVICE

CROSS-REFERENCE TO RELATED APPLICATIONS

This application is based upon and claims the benefit of priority from Japanese Patent Application No. 2023-169906, filed on Sep. 29, 2023; the entire contents of which are incorporated herein by reference.

This application is based upon and claims the benefit of priority from Japanese Patent Application No. 2023-169930, filed on Sep. 29, 2023; the entire contents of which are incorporated herein by reference.

FIELD

Embodiments described herein relate generally to a sanitary washing device.

BACKGROUND

A sanitary washing device known in the art includes a nozzle that advances into a toilet when performing a private part wash. One such known nozzle has a curved shape and advances and retreats along an arc-like trajectory (Japanese Patent No. 6551717).

When a flow channel inside the nozzle has a large curve, it may be necessary to reduce the area of the flow channel in order to remove a mold pin when manufacturing the nozzle. Reducing the flow channel area may make the water discharged from the nozzle unstable.

SUMMARY

According to the embodiment, a sanitary washing device includes a casing and a nozzle unit. The nozzle unit advances and retreats between the casing and a toilet. The nozzle unit is curved to be upwardly convex and advances and retreats along an arc-like trajectory. The nozzle unit includes a first flow channel through which water flows and a second flow channel connected to the first flow channel. A water flow direction of the second flow channel in a longitudinal direction of the nozzle unit is different from a water flow direction of the first flow channel in the longitudinal direction.

DETAILED DESCRIPTION

Figure 1:
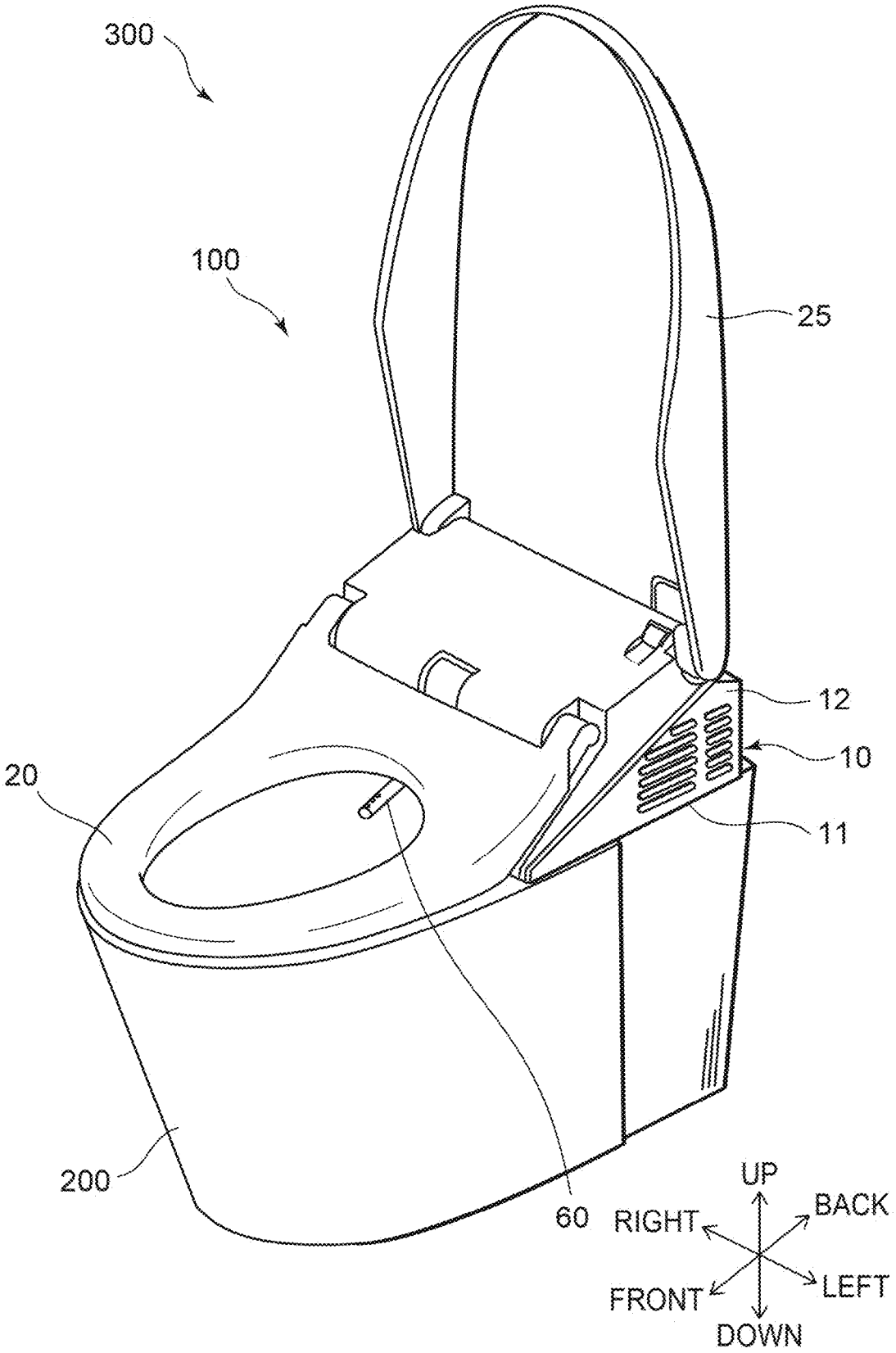
FIG. 1 is a perspective view showing a toilet device including a sanitary washing device according to an embodiment.

A first invention is a sanitary washing device including a casing, and a nozzle unit configured to advance and retreat between the casing and a toilet; the nozzle unit is curved to be upwardly convex, and is configured to advance and retreat along an arc-like trajectory; the nozzle unit includes a first flow channel through which water flows, and a second flow channel connected to the first flow channel; and a water flow direction of the second flow channel in a longitudinal direction of the nozzle unit is different from a water flow direction of the first flow channel in the longitudinal direction.

According to the sanitary washing device, the nozzle unit is curved to be upwardly convex, and advances and retreats along an arc-like trajectory. Such a configuration improves the creativity of the sanitary washing device because the height dimension of the casing can be reduced as much as possible. The nozzle unit includes a first flow channel through which water flows, and a second flow channel connected to the first flow channel. A water flow direction of the second flow channel in a longitudinal direction of the nozzle unit is different from a water flow direction of the first flow channel in the longitudinal direction. As a result, the first and second flow channels of the nozzle unit can change the water flow direction in stages, thereby ensuring the flow channel area and stabilizing the water discharge.

A second invention is the sanitary washing device of the first invention, wherein the first flow channel and the second flow channel each extend in linear shapes.

According to the sanitary washing device, the nozzle unit can be efficiently manufactured because the mold pin can be easily removed from the first and second flow channels. Because the flow channel area of the first and second flow channels can be ensured, the water discharge can be stabilized even when the nozzle unit has a curved shape.

A third invention is the sanitary washing device of the first or second invention, wherein the nozzle unit includes a nozzle main body, and a nozzle cover covering the nozzle main body; the nozzle cover is curved to be upwardly convex; the nozzle main body includes a first cylindrical part including the first flow channel, and a second cylindrical part including the second flow channel; an outer surface of the first cylindrical part extends in a linear shape in a longitudinal direction of the first cylindrical part; and the outer surface of the second cylindrical part extends in a linear shape in a longitudinal direction of the second cylindrical part.

According to the sanitary washing device, for example, compared to when the first cylindrical part and the second cylindrical part are curved, a constant wall thickness can be ensured between the first flow channel and the outer surface of the first cylindrical part and between the second flow channel and the outer surface of the second cylindrical part. Therefore, the water discharge can be stabilized while guaranteeing the durability of the nozzle main body.

A fourth invention is a sanitary washing device of the third invention, wherein the second cylindrical part is connected to a front of the first cylindrical part.

According to the sanitary washing device, the durability of the nozzle main body can be improved compared to, for example, a multistage nozzle unit in which the second cylindrical part advances to protrude from the interior of the first cylindrical part.

A fifth invention is the sanitary washing device of the first or second invention, wherein an angle between the first flow channel and horizontal is less than an angle between the second flow channel and horizontal.

According to the sanitary washing device, the cylindrical parts in which the flow channels are made can be formed to extend along the nozzle cover, which is curved to be upwardly convex, while maintaining a constant wall thickness of the cylindrical parts. Therefore, compared to when the flow channel is curved upward, physical interference between the nozzle cover and the cylindrical parts can be suppressed, and the nozzle main body can be compact.

A sixth invention is the sanitary washing device of a fifth invention, wherein the nozzle unit includes a first cylindrical part including the first flow channel, a second cylindrical part including the second flow channel, and a nozzle head connected to a front of the second cylindrical part; the nozzle head includes a third flow channel; and an angle between the third flow channel and horizontal is greater than an angle between the second flow channel and horizontal.

According to the sanitary washing device, the first cylindrical part, the second cylindrical part, and the nozzle head can be more compact, and so the first cylindrical part, the second cylindrical part, and the nozzle head can be easily stored in the nozzle cover.

A seventh invention is the sanitary washing device of the sixth invention, wherein a length of the first cylindrical part, a length of the second cylindrical part, and a length of the nozzle head are equal.

According to the sanitary washing device, the change amount of the inclination angles of the first cylindrical part, the second cylindrical part, and the nozzle head can be constant. Accordingly, the effects of the pressure loss caused by connecting multiple flow channels can be suppressed, and the water discharge can be more stable.

An eighth invention is the sanitary washing device of the first invention, wherein the nozzle unit includes a cylindrical part, a nozzle head connected to a front surface part of the cylindrical part, and a nozzle cover covering the cylindrical part and the nozzle head; the nozzle cover is curved to be upwardly convex; and the nozzle head extends to be bent from the front surface part of the cylindrical part.

According to the sanitary washing device, the nozzle cover is curved to be upwardly convex. The nozzle unit advances and retreats along an arc-like trajectory. Such a configuration can improve the creativity of the sanitary washing device because the height dimension of the casing can be reduced as much as possible. The degree of freedom of the water discharge position can be increased because the nozzle head extends to be bent from the cylindrical part.

A ninth invention is a sanitary washing device of the eighth invention, wherein the front surface part of the cylindrical part is perpendicular to a longitudinal direction of the cylindrical part.

According to the sanitary washing device, the tilt of the nozzle head itself can be changed while increasing the strength at the cylindrical part side which bears the weight of the nozzle head.

A tenth invention is the sanitary washing device of the eighth invention, wherein the nozzle head includes a back surface part connected to the front surface part of the cylindrical part, and a tip surface part facing the back surface part in the longitudinal direction of the nozzle head; the tip surface part is inclined in a same direction as the back surface part with respect to a perpendicular plane; and the perpendicular plane is perpendicular to the longitudinal direction of the nozzle head.

According to the sanitary washing device, a compact sanitary washing device can be provided in which the forward protrusion of the nozzle unit when the nozzle unit is stored inside the casing can be suppressed.

An eleventh invention is the sanitary washing device of the eighth invention, wherein the cylindrical part and the nozzle head include a positioning part for fixing a position of the nozzle head with respect to the cylindrical part.

According to the sanitary washing device, misconnection between the flow channel of the cylindrical part and the flow channel of the nozzle head can be suppressed.

A twelfth invention is the sanitary washing device of the eleventh invention, wherein the positioning part includes a recess disposed in the cylindrical part, and a protrusion disposed in the nozzle head; and the protrusion is inserted into the recess.

According to the sanitary washing device, by disposing the recess in the cylindrical part, a sufficient engaging overlap can be ensured, and the strength can be guaranteed.

Embodiments of the invention will now be described with reference to the drawings. Similar components in the drawings are marked with the same reference numerals; and a detailed description is omitted as appropriate.

FIG. 1 is a perspective view showing a toilet device including a sanitary washing device according to an embodiment.

As shown in FIG. 1, the toilet device 300 according to the embodiment includes the sanitary washing device 100 and a western-style sit-down toilet 200 (hereinbelow, called simply the "toilet" 200 for convenience of description). The sanitary washing device 100 is disposed on the toilet 200. The sanitary washing device 100 includes a private part washing device 30 for washing a private part of a user seated on a toilet seat 20.

A casing 10 includes a case plate 11 and a case cover 12. The case plate 11 forms the bottom portion of the casing 10. The case plate 11 is placed on the back part of the toilet 200. The case cover 12 is disposed on the case plate 11 and covers the top of the case plate 11. The toilet seat 20 and a toilet lid 25 are pivotally supported by the case cover 12 to be rotatable. The case cover 12 includes an openable and closable lid part 12*a* at the front of a nozzle unit 60 described below. The lid part 12*a* is opened by being pressed when the nozzle unit 60 advances into the toilet 200.

The casing 10 stores the private part washing device 30 inside a space surrounded with the case plate 11 and the case cover 12. Functional units such as, for example, an opening/closing unit that controls the open/close operations of the toilet seat 20 and the toilet lid 25, a toilet seat heating unit that controls the temperature of the toilet seat 20, a communication unit that can communicate with an operation part 140, etc., are stored inside the casing 10.

In this specification, "up/upward/above", "down/downward/below", "front/frontward/forward", "back/backward/behind", "right", and "left" are directions when viewed by a user sitting on the toilet seat 20 with the user's back facing the toilet lid 25 as shown in FIG. 1.

Figure 2:
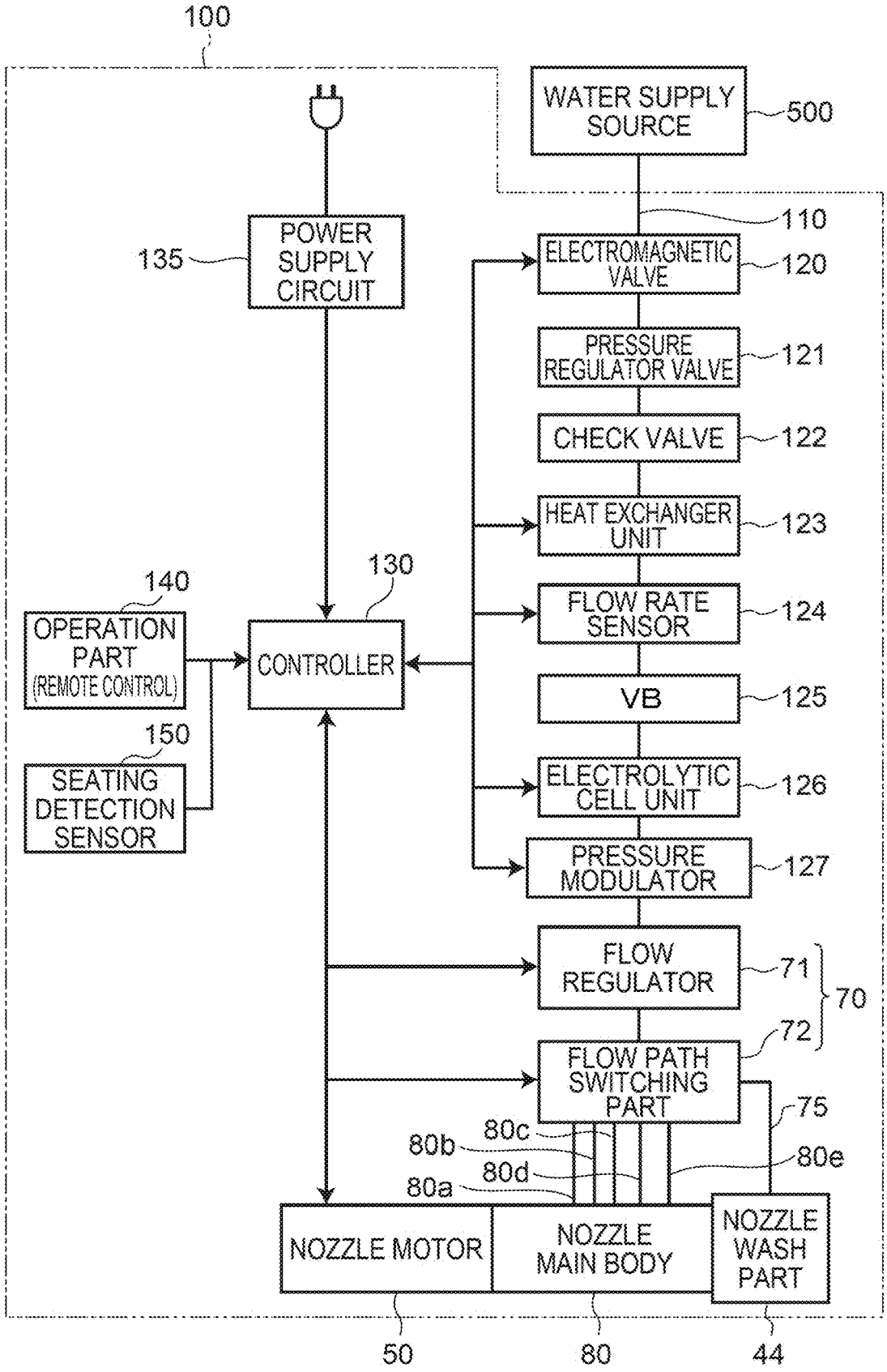
FIG. 2 is a block diagram showing relevant components of the sanitary washing device.

FIG. 2 is a block diagram showing relevant components of the sanitary washing device.

FIG. 2 shows relevant components of both a water channel system and an electrical system of the sanitary washing device 100.

As shown in FIG. 2, the sanitary washing device 100 includes a pipe line 110. The pipe line 110 extends to the nozzle unit 60 from a water supply source 500 such as a service water line, a water storage tank, etc. The pipe line 110 guides the water supplied from the water supply source 500 to the nozzle unit 60.

An electromagnetic valve 120 is disposed at the upstream side of the pipe line 110. The electromagnetic valve 120 is an openable and closable electromagnetic valve and controls the supply of the water based on a command from a controller 130 disposed inside the casing 10. In other words, the electromagnetic valve 120 opens and closes the pipe line 110. The water that is supplied from the water supply source 500 is caused to flow in the pipe line 110 by setting the electromagnetic valve 120 to the open state.

A pressure regulator valve 121 is disposed downstream of the electromagnetic valve 120. The pressure regulator valve 121 regulates the pressure inside the pipe line 110 to be within a prescribed pressure range when the water supply pressure is high. A check valve 122 is disposed downstream of the pressure regulator valve 121. The check valve 122 suppresses the backflow of water toward the upstream side of the check valve 122 when the pressure inside the pipe line 110 drops, etc.

A heat exchanger unit 123 (a heater) is disposed downstream of the check valve 122. The heat exchanger unit 123 includes a heater and heats the water supplied from the water supply source 500 to a specified temperature. In other words, the heat exchanger unit 123 produces warm water.

The heat exchanger unit 123 is, for example, an instant heating-type (instantaneous-type) heat exchanger that uses a ceramic heater, etc. Compared to a warm water storage heating-type heat exchanger that uses a warm water storage tank, the instant heating-type heat exchanger can heat the water to the specified temperature in a short period of time. The heat exchanger unit 123 is not limited to an instant heating-type heat exchanger and may be a warm water storage heating-type heat exchanger. The heater is not limited to a heat exchanger; for example, another heating technique such as one that utilizes microwave heating, etc., may be used.

The heat exchanger unit 123 is connected with the controller 130. For example, the controller 130 heats the water to a temperature set by the operation part 140 by controlling the heat exchanger unit 123 according to an operation of the operation part 140 by the user.

A flow rate sensor 124 is disposed downstream of the heat exchanger unit 123. The flow rate sensor 124 detects the flow rate of the water discharged from the heat exchanger unit 123. In other words, the flow rate sensor 124 detects the flow rate of the water flowing through the pipe line 110. The flow rate sensor 124 is connected to the controller 130. The flow rate sensor 124 inputs the detection result of the flow rate to the controller 130.

A vacuum breaker (VB) 125 is disposed downstream of the flow rate sensor 124. The vacuum breaker 125 includes, for example, a flow channel for allowing the water to flow, an intake for drawing air into the flow channel, and a valve mechanism that opens and closes the intake. For example, the valve mechanism blocks the intake when water is flowing in the flow channel, and draws air into the flow channel by opening the intake when the flow of the water stops. In other words, the vacuum breaker 125 draws air into the pipe line 110 when the water does not flow in the pipe line 110. The valve mechanism includes, for example, a float valve.

The vacuum breaker 125 draws air into the pipe line 110, thereby promoting, for example, water drainage of the part of the pipe line 110 downstream of the vacuum breaker 125. For example, the vacuum breaker 125 promotes the water drainage of the nozzle unit 60. Thus, the vacuum breaker 125 drains the water inside the nozzle unit 60 and draws air into the nozzle unit 60, thereby suppressing, for example, the undesirable backflow of the water supply source 500 (the fresh water) side of the wash water inside the nozzle unit 60, etc.

An electrolytic cell unit 126 is disposed downstream of the vacuum breaker 125. The electrolytic cell unit 126 generates a liquid (functional water) including hypochlorous acid from the tap water by electrolyzing the tap water flowing through the interior of the electrolytic cell unit 126. The electrolytic cell unit 126 is connected to the controller 130. The electrolytic cell unit 126 generates functional water based on a control by the controller 130.

The functional water that is generated by the electrolytic cell unit 126 may be, for example, a solution including metal ions such as silver ions, copper ions, etc. Or, the functional water that is generated by the electrolytic cell unit 126 may be a solution including electrolytic chlorine, ozone, etc. Or, the functional water that is generated by the electrolytic cell unit 126 may be acidic water and alkaline water.

A pressure modulator 127 is disposed downstream of the electrolytic cell unit 126. The pressure modulator 127 applies a pulsatory motion to the water discharged from a bottom wash water discharge port 85*b*, a gentle wash water discharge port 85*c*, and a bidet wash water discharge port 85*d* of a nozzle main body 80 and the water discharger of a nozzle wash part 44 by applying a pulsatory motion or an acceleration to the flow of the water inside the pipe line 110. In other words, the pressure modulator 127 causes the fluidic state of the water flowing through the pipe line 110 to fluctuate. The pressure modulator 127 is connected to the controller 130. The pressure modulator 127 causes the fluidic state of the water to fluctuate based on a control by the controller 130. The pressure modulator 127 causes the pressure of the water inside the pipe line 110 to fluctuate.

A flow regulating unit 70 is disposed downstream of the pressure modulator 127. The flow regulating unit 70 includes a flow regulator 71 and a flow path switching part 72. The flow regulator 71 regulates the water force (the flow rate). The flow path switching part 72 is disposed downstream of the flow regulator 71. The flow path switching part 72 performs opening, closing, and switching of the water supply to the nozzle main body 80 and/or the nozzle wash part 44. The flow regulator 71 and the flow path switching part 72 may be separately disposed. The flow regulator 71 and the flow path switching part 72 are connected to the controller 130. The operations of the flow regulator 71 and the flow path switching part 72 are controlled by the controller 130.

The flow regulating unit 70 is a part of the nozzle unit 60. The flow regulating unit 70 is connected to the back surface of the nozzle main body 80. The flow regulating unit 70 includes a case 73 in which the flow regulator 71 and the flow path switching part 72 are stored. A protrusion 73*a* and a recess 73*b* that are slidably held by a supporter 40 (described below) are disposed in the case 73.

A bottom wash channel 80*a*, a gentle wash channel 80*b*, a bidet wash channel 80*c*, a first bowl spout channel 80*d*, a second bowl spout channel 80*e*, and a surface wash channel 75 are disposed downstream of the flow path switching part 72. The bottom wash channel 80*a*, the gentle wash channel 80*b*, the bidet wash channel 80*c*, the first bowl spout channel 80*d*, and the second bowl spout channel 80*e* are disposed inside the nozzle main body 80. The surface wash channel 75 is a pipe line (not illustrated) connecting between the flow path switching part 72 and the nozzle wash part 44.

The bottom wash channel 80*a* causes water and/or the functional water generated by the electrolytic cell unit 126 to flow from the flow path switching part 72 toward the bottom wash water discharge port 85*b*. The gentle wash channel 80*b* causes water and/or the functional water generated by the electrolytic cell unit 126 to flow from the flow path switching part 72 toward the gentle wash water discharge port 85*c*. The bidet wash channel 80*c* causes water and/or the functional water generated by the electrolytic cell unit 126 to flow from the flow path switching part 72 toward the bidet wash water discharge port 85*d*. The first bowl spout channel 80*d* causes water and/or the functional water generated by the electrolytic cell unit 126 to flow from the flow path switching part 72 toward a first spout hole 85*e*. The second bowl spout channel 80*e* causes water and/or the functional water generated by the electrolytic cell unit 126 to flow from the flow path switching part 72 toward a second spout hole 85*f*. The surface wash channel 75 causes water and/or the functional water generated by the electrolytic cell unit 126 to flow from the flow path switching part 72 toward the nozzle wash part 44.

By controlling the flow path switching part 72, the controller 130 switches the opening and closing of the flow channels of the bottom wash channel 80*a*, the gentle wash channel 80*b*, the bidet wash channel 80*c*, the first bowl spout channel 80*d*, the second bowl spout channel 80*e*, and the surface wash channel 75. Thus, the flow path switching part 72 switches between the state of communicating with the pipe line 110 and the state of not communicating with the pipe line 110 for each of the multiple water discharge ports of the bottom wash water discharge port 85*b*, the gentle wash water discharge port 85*c*, the bidet wash water discharge port 85*d*, the nozzle wash part 44, the first and second spout holes 85*e* and 85*f*, etc.

The controller 130 is supplied with power from a power supply circuit 135 and controls the operations of the electromagnetic valve 120, the heat exchanger unit 123, the electrolytic cell unit 126, the pressure modulator 127, the flow regulator 71, the flow path switching part 72, a nozzle motor 50, etc., based on signals from a seating detection sensor 150, the flow rate sensor 124, the operation part 140, etc. As a result, the controller 130 controls the operation of the nozzle unit 60.

The private part washing device 30 that is disposed inside the casing 10 will now be described.

Figure 3:
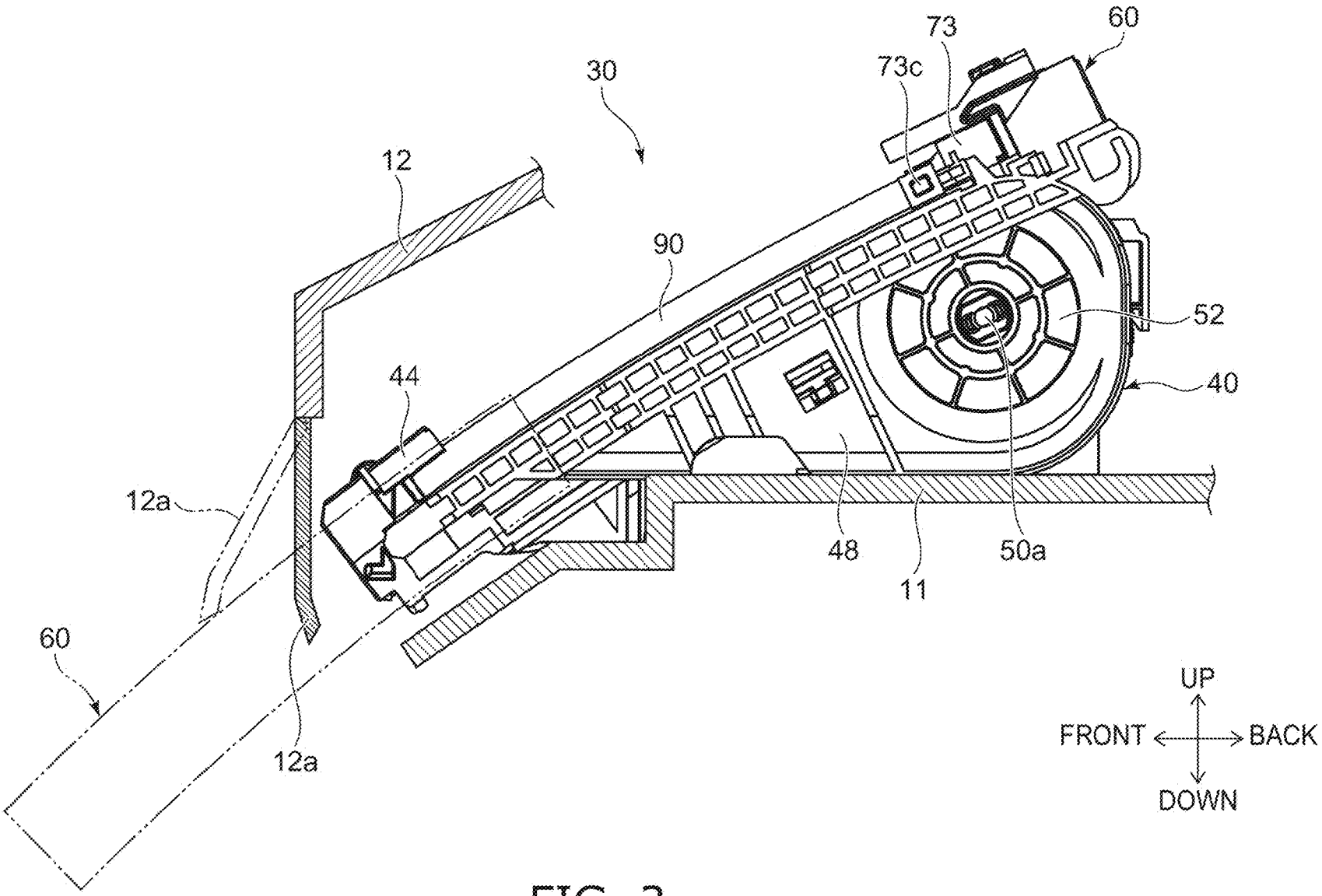
FIG. 3 is a cross-sectional view of the private part washing device inside the casing when viewed laterally.

FIG. 3 is a cross-sectional view of the private part washing device inside the casing when viewed laterally.

Figure 4:
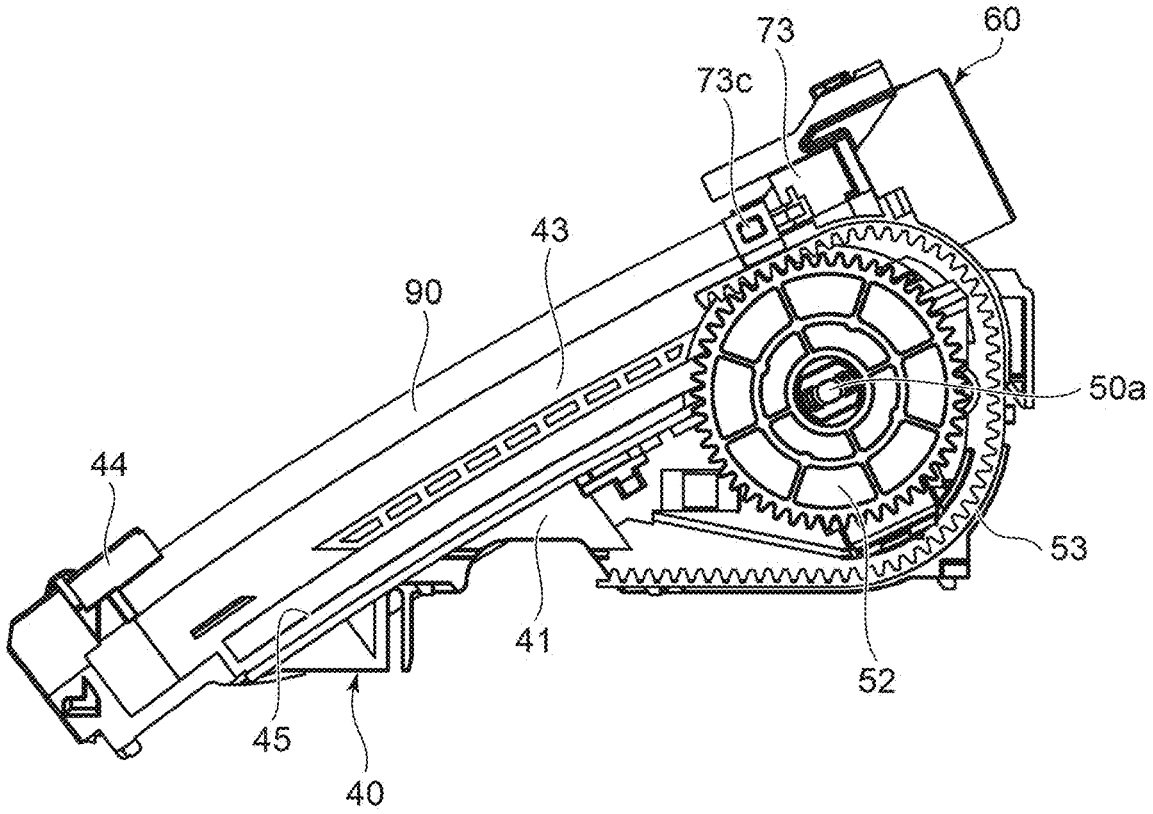
FIG. 4 is a side view showing a state in which the cover part is detached from the main part of the supporter.

FIG. 4 is a side view showing a state in which the cover part is detached from the main part of the supporter.

Figure 5:
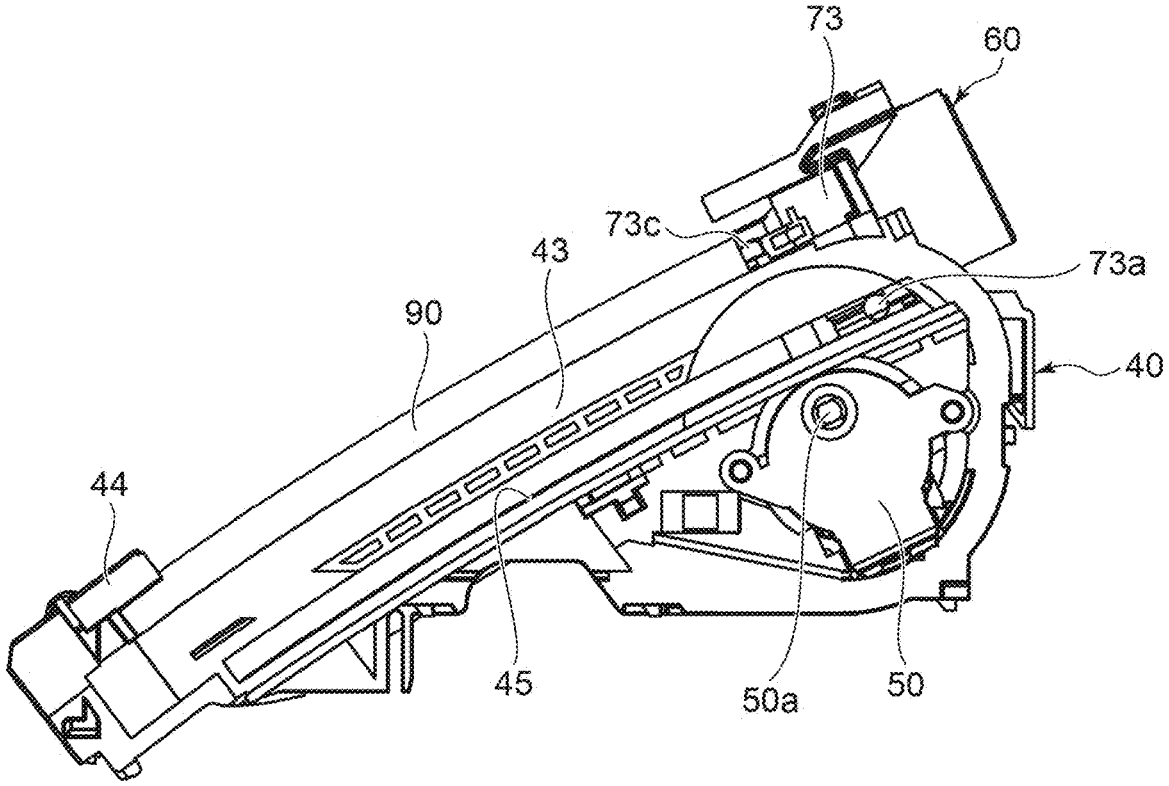
FIG. 5 is a side view showing a state in which a gear and a belt are detached from the supporter in FIG. 4.

FIG. 5 is a side view showing a state in which a gear and a belt are detached from the supporter in FIG. 4.

Figure 6:
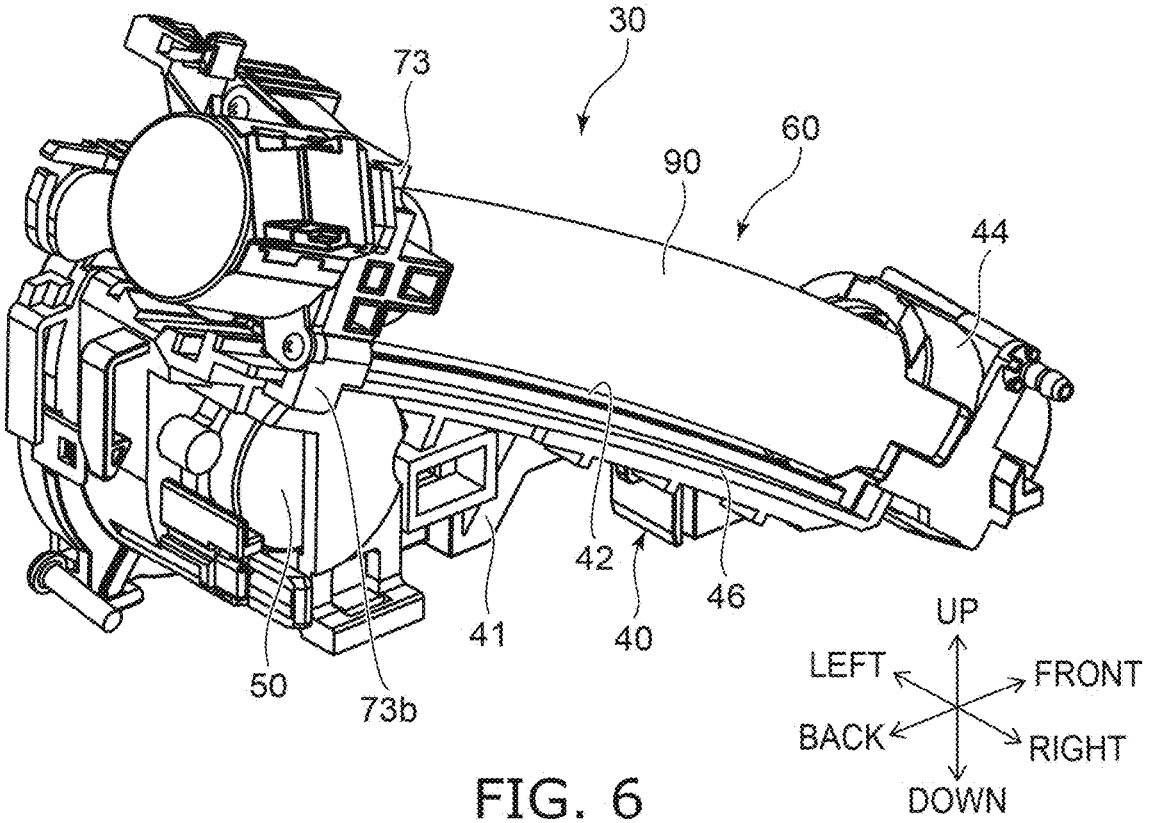
FIG. 6 is a perspective view of the private part washing device when viewed obliquely from behind.

FIG. 6 is a perspective view of the private part washing device when viewed obliquely from behind.

Figure 7:
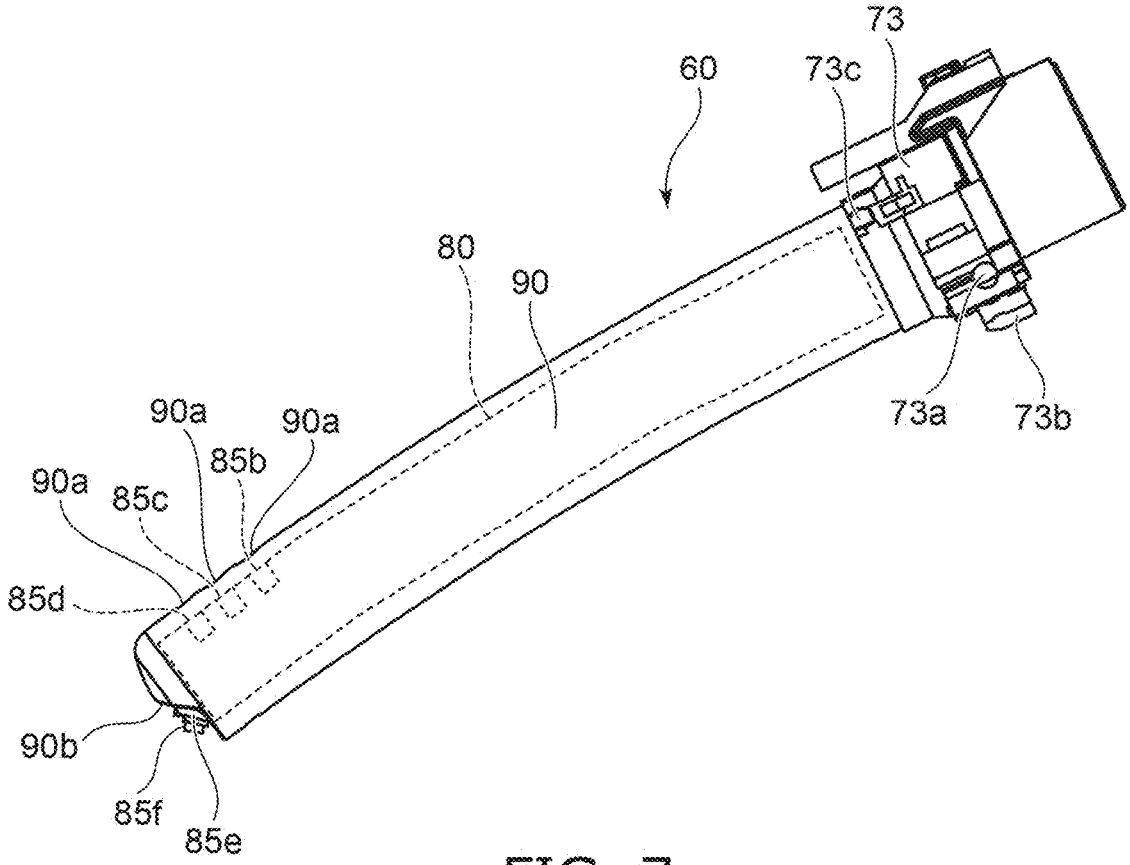
FIG. 7 is a side view showing the nozzle unit alone.

FIG. 7 is a side view showing the nozzle unit alone.

Figure 8:
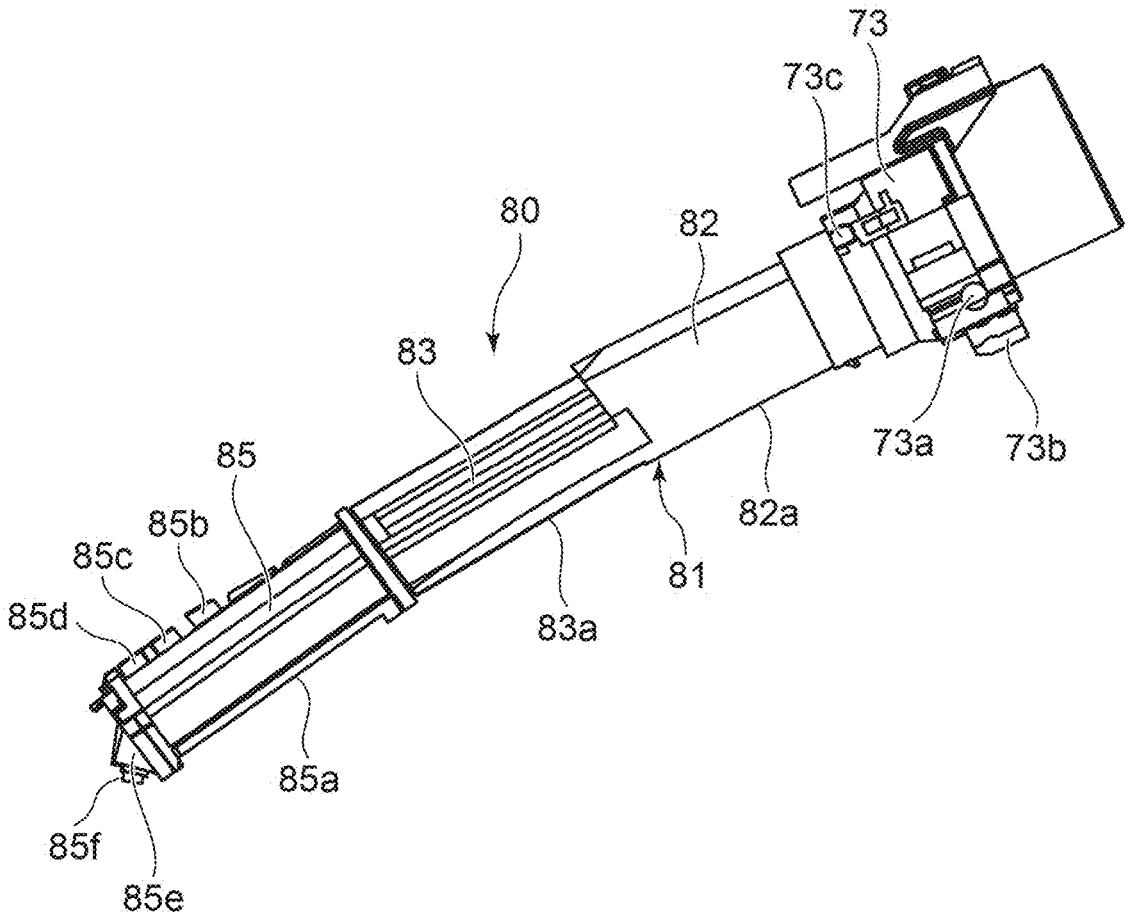
FIG. 8 is a side view showing a state in which the nozzle cover is detached from the nozzle unit in FIG. 7.

FIG. 8 is a side view showing a state in which the nozzle cover is detached from the nozzle unit in FIG. 7.

Figure 9:
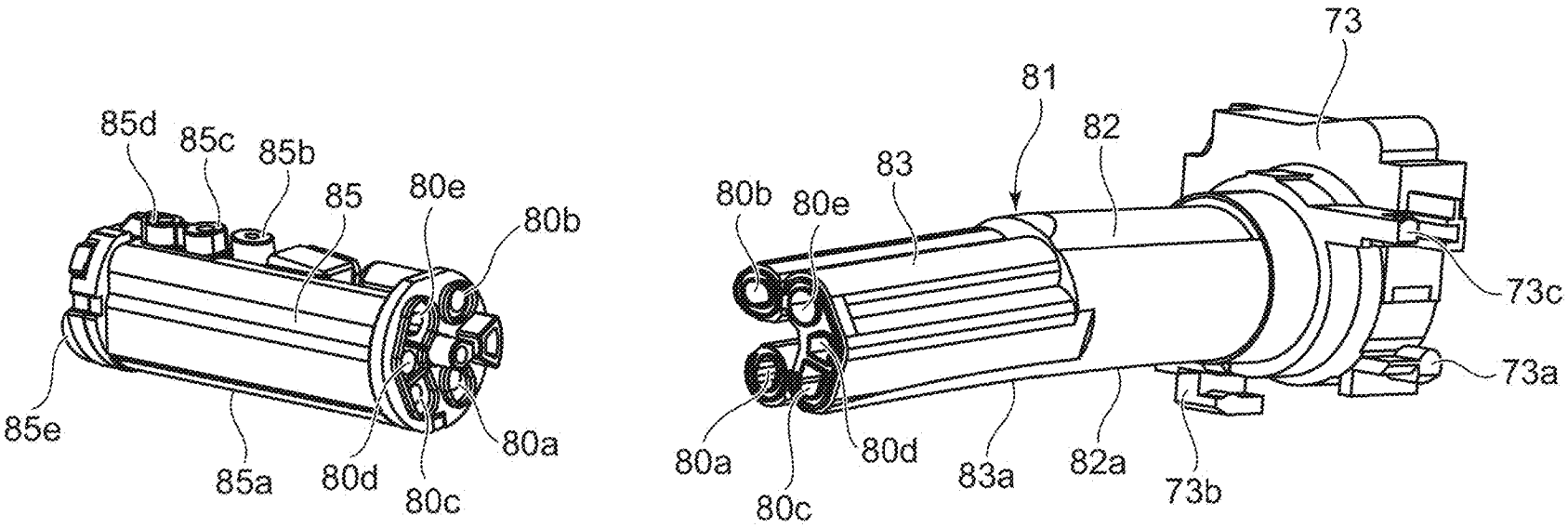
FIG. 9 is a perspective view showing a state in which the nozzle head is detached from the second cylindrical part.

FIG. 9 is a perspective view showing a state in which the nozzle head is detached from the second cylindrical part.

Figure 10:
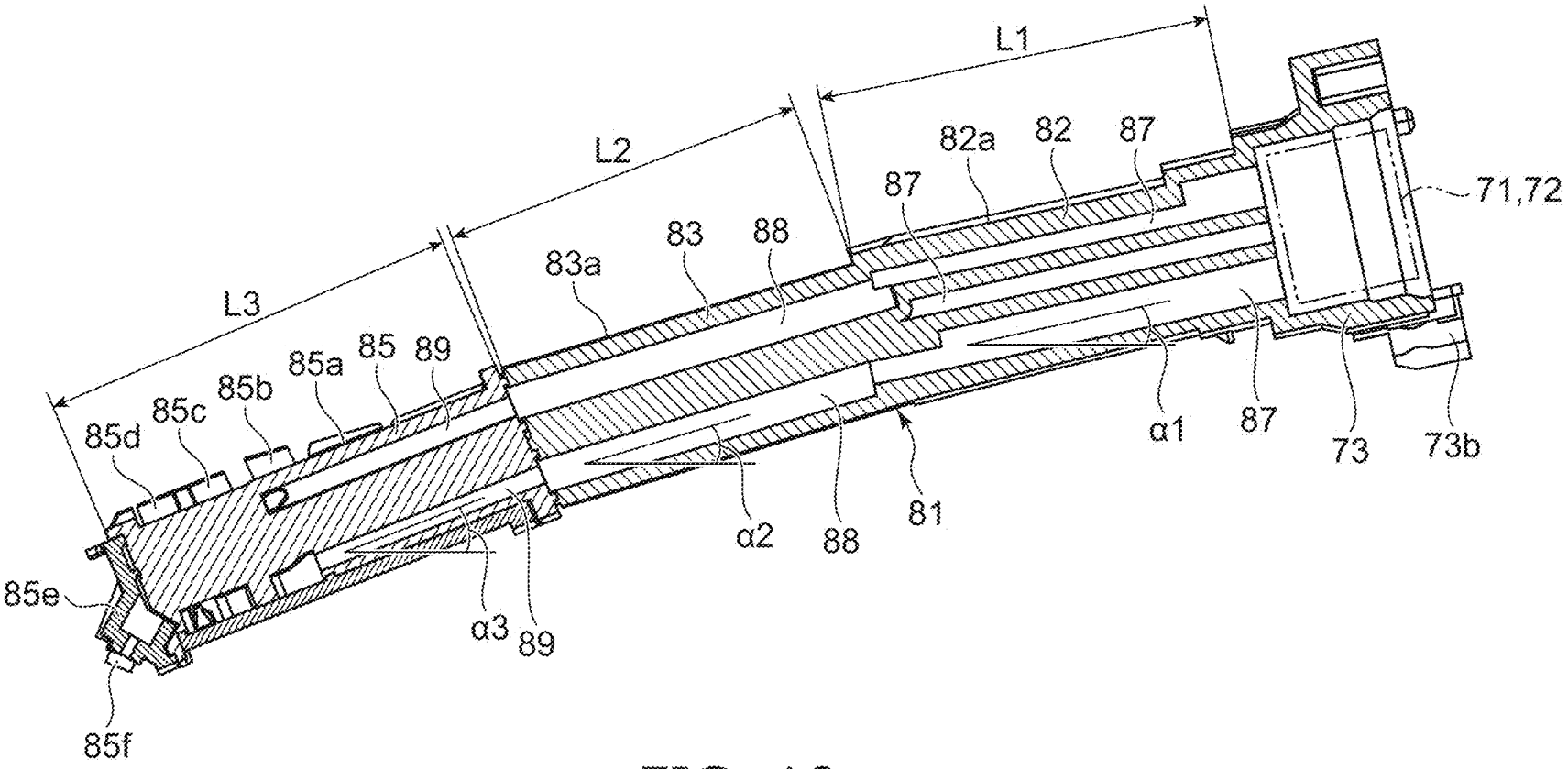
FIG. 10 is a cross-sectional view showing the flow channel disposed inside the nozzle main body.

FIG. 10 is a cross-sectional view showing the flow channel disposed inside the nozzle main body.

The private part washing device 30 washes a private part of the user seated on the toilet seat 20. In the example, the private part washing device 30 also has the function of suppressing the adhesion of dirt inside the toilet 200 by squirting water or functional water into the toilet 200. Such a function may be provided as necessary. The private part washing device 30 includes the supporter 40 that is disposed at the case plate 11 of the casing 10, and the nozzle unit 60 that is slidably supported by the supporter 40.

The supporter 40 is positioned below the nozzle unit 60 and supports the nozzle unit 60 from below. The supporter 40 includes a main part 41, and a cover part 48 covering the side of the main part 41. As shown in FIGS. 4 to 6, the main part 41 includes a bottom portion 42 extending in the longitudinal direction, a vertical part 43 extending upward from the bottom portion 42, and the nozzle wash part 44 positioned at the front end side of the bottom portion 42 and the vertical part 43. The bottom portion 42 and the vertical part 43 are inclined frontward and downward from the back. The bottom portion 42 and the vertical part 43 have shapes that are curved to be upwardly convex to correspond to the shape of a nozzle cover 90.

The nozzle wash part 44 covers the outer perimeter of the nozzle cover 90. The nozzle wash part 44 washes the outer perimeter surface (the body) of the nozzle cover 90 by, for example, squirting functional water or water from a water discharger.

The supporter 40 includes a groove part 45 extending in the advance/retreat direction of the nozzle unit 60, and a rail part 46 extending in the advance/retreat direction of the nozzle unit 60 at a different position from the groove part 45. The groove part 45 and the rail part 46 are parts that guide the nozzle unit 60 when the nozzle unit 60 advances and retreats between the interior of the casing 10 and the interior of the toilet 200.

The groove part 45 penetrates the vertical part 43 in the thickness direction (the lateral direction). The groove part 45 extends in the longitudinal direction to be curved to be upwardly convex to correspond to the shape of the nozzle cover 90. The protrusion 73*a* (described below) of the nozzle unit 60 is held by the groove part 45.

The rail part 46 is disposed to protrude in the lateral direction from the bottom portion 42. The rail part 46 is formed in a flat plate shape that extends in the longitudinal direction. The rail part 46 extends in the longitudinal direction to be curved to be upwardly convex to correspond to the shape of the nozzle cover 90. The recess 73*b* (described below) of the nozzle unit 60 is held by the rail part 46. The nozzle unit 60 advances and retreats along an arc-like trajectory due to the groove part 45 and the rail part 46 being curved in the longitudinal direction.

The nozzle motor 50 is disposed at the supporter 40. For example, the nozzle motor 50 is disposed below the bottom portion 42. The nozzle motor 50 is a drive part that causes the nozzle unit 60 to advance and retreat. The nozzle motor 50 is connected to the controller 130. The nozzle motor 50 is operated based on an operation instruction when the operation part 140 is operated.

As shown in FIG. 4, a gear 52 is positioned at the side surface of the main part 41 and mounted to a rotary shaft 50*a* of the nozzle motor 50. The gear 52 is rotated by an operation of the nozzle motor 50. A cable rack 53 is positioned at the periphery of the gear 52 and meshes with the gear 52. The cable rack 53 is a rack gear that converts the rotational motion of the gear 52 into linear motion. The cable rack 53 engages an engaging part 73*c* disposed at the case 73 of the flow regulating unit 70.

The nozzle unit 60 is curved to be upwardly convex and advances and retreats along an arc-like trajectory. Specifically, the cable rack 53 is moved frontward when the gear 52 is rotated counterclockwise from the state shown in FIG. 4. The nozzle unit 60 advances toward the interior of the toilet 200 due to the cable rack 53 pressing the engaging part 73*c* frontward. On the other hand, the cable rack 53 moves backward when the gear 52 is rotated clockwise. The nozzle unit 60 retreats into the casing 10 due to the cable rack 53 pressing the engaging part 73*c* backward.

The nozzle unit 60 includes the flow regulating unit 70, the nozzle main body 80 positioned at the front of the flow regulating unit 70, and the nozzle cover 90 covering the outer perimeter of the nozzle main body 80. The flow regulating unit 70 includes the flow regulator 71, the flow path switching part 72, and the case 73 that stores the flow regulator 71 and the flow path switching part 72. The nozzle main body 80 includes a first flow channel 87 through which water flows, a second flow channel 88 connected to the first flow channel 87, and a third flow channel 89 connected to the second flow channel 88. The first to third flow channels 87 to 89 are described below.

The case 73 of the flow regulating unit 70 is mounted to the nozzle main body 80. The nozzle cover 90 is mounted to the case 73 and the nozzle main body 80. As a result, in the nozzle unit 60, the flow regulating unit 70, the nozzle main body 80, and the nozzle cover 90 slide in the longitudinal direction with respect to the supporter 40 as a continuous body.

The case 73 includes the cylindrical protrusion 73*a* that is held by the groove part 45 of the supporter 40 by being sandwiched in the vertical direction, and the recess 73*b* that holds the rail part 46 of the supporter 40 by the rail part 46 being sandwiched in the vertical direction. The protrusion 73*a* is disposed at a position corresponding to the groove part 45 of the supporter 40. The recess 73*b* is disposed at a position corresponding to the rail part 46 of the supporter 40.

The engaging part 73*c* is disposed above the protrusion 73*a*. As shown in FIG. 4, the cable rack 53 engages the engaging part 73*c*. The rotational force of the nozzle motor 50 is transmitted from the gear 52 to the engaging part 73*c* via the cable rack 53. The nozzle unit 60 advances and retreats between the interior of the casing 10 and the interior of the toilet 200 due to the cable rack 53 moving the engaging part 73*c* in the longitudinal direction.

The nozzle main body 80 is disposed at the front of the flow regulating unit 70. The bottom wash channel 80*a*, the gentle wash channel 80*b*, the bidet wash channel 80*c*, the first bowl spout channel 80*d*, and the second bowl spout channel 80*e* are disposed inside the nozzle main body 80. The water and/or functional water that flows inside the flow regulating unit 70 is caused to flow in the bottom wash channel 80*a*, the gentle wash channel 80*b*, the bidet wash channel 80*c*, the first bowl spout channel 80*d*, the second bowl spout channel 80*e*, and the surface wash channel 75 by operations of the flow path switching part 72.

The nozzle main body 80 includes a cylindrical part 81 and a nozzle head 85. The cylindrical part 81 includes a first cylindrical part 82 and a second cylindrical part 83. The first cylindrical part 82 is connected at the front of the case 73 of the flow regulating unit 70. The second cylindrical part 83 is connected to the front of the first cylindrical part 82. The nozzle head 85 is connected to the front of the second cylindrical part 83. The nozzle head 85 extends to be bent from the second cylindrical part 83 in a state in which a back surface part 85*g* is connected to a front surface part 83*b* of the second cylindrical part 83. Specific bonding states of the cylindrical part 81 and the nozzle head 85 are described below.

For example, the first cylindrical part 82, the second cylindrical part 83, and the nozzle head 85 are formed of a resin material so that outer surfaces 82*a*, 83*a*, and 85*a* have linear shapes in the longitudinal directions. The first cylindrical part 82 and the second cylindrical part 83 may be adhered or detachable. For example, the first cylindrical part 82 and the second cylindrical part 83 are bonded using welding, rubber packing, etc. The first cylindrical part 82 and the second cylindrical part 83 may be formed to have a continuous body. For example, the nozzle head 85 may be adhered to the second cylindrical part 83 or may be detachable. For example, the nozzle head 85 is bonded to the second cylindrical part 83 using welding, rubber packing, etc.

The bottom wash channel 80*a*, the gentle wash channel 80*b*, the bidet wash channel 80*c*, the first bowl spout channel 80*d*, and the second bowl spout channel 80*e* extend through the interiors of the first cylindrical part 82, the second cylindrical part 83, and the nozzle head 85 in the longitudinal directions (the longitudinal directions). Specifically, as shown in FIG. 9, five flow channels are formed inside the first cylindrical part 82, the second cylindrical part 83, and the nozzle head 85.

The nozzle head 85 includes the bottom wash water discharge port 85*b*, the gentle wash water discharge port 85*c*, the bidet wash water discharge port 85*d*, the first spout hole 85*e*, and the second spout hole 85*f*. The bottom wash water discharge port 85*b* is connected to the bottom wash channel 80*a*. The gentle wash water discharge port 85*c* is connected to the gentle wash channel 80*b*. The bidet wash water discharge port 85*d* is connected to the bidet wash channel 80*c*. The first spout hole 85*e* is connected to the first bowl spout channel 80*d*. The second spout hole 85*f* is connected to the second bowl spout channel 80*e*.

The nozzle main body 80 can wash the "bottom" of the user sitting on the toilet seat 20 by squirting hot water from the bottom wash water discharge port 85*b* or the gentle wash water discharge port 85*c* of the nozzle head 85. The gentle wash water discharge port 85*c* discharges a softer water stream than the bottom wash water discharge port 85*b*. Also, the nozzle main body 80 can wash a female private part of a female sitting on the toilet seat 20 by squirting hot water from the bidet wash water discharge port 85*d* of the nozzle head 85.

For example, the first spout hole 85*e* and the second spout hole 85*f* are arranged at the front surface (a tip surface part 85*h*) of the nozzle head 85. The first spout hole 85*e* and the second spout hole 85*f* squirt water or functional water toward the interior of the toilet 200. The first spout hole 85*e* and the second spout hole 85*f* squirt water and functional water with different orientations in the longitudinal direction. The water or functional water squirted from the first and second spout holes 85*e* and 85*f* into the toilet 200 suppresses the adhesion of dirt inside the toilet 200.

Configurations of the bottom wash channel 80*a*, the gentle wash channel 80*b*, the bidet wash channel 80*c*, the first bowl spout channel 80*d*, and the second bowl spout channel 80*e* will now be described with reference to FIG. 10.

Each of the bottom wash channel 80*a*, the gentle wash channel 80*b*, the bidet wash channel 80*c*, the first bowl spout channel 80*d*, and the second bowl spout channel 80*e* includes one of the first flow channels 87 disposed inside the first cylindrical part 82, one of the second flow channels 88 disposed inside the second cylindrical part 83, and one of the third flow channels 89 disposed inside the nozzle head 85. The first flow channel 87, the second flow channel 88, and the third flow channel 89 are connected in the longitudinal direction of the nozzle unit 60.

Here, the first cylindrical part 82, the second cylindrical part 83, and the nozzle head 85 are manufactured by, for example, injection molding. When the first and second flow channels 87 and 88 are curved to match the shape of the nozzle cover 90, the hole diameters of the first and second flow channels 87 and 88 may be undesirably reduced to remove the mold pins.

Therefore, as shown in FIG. 10, the first flow channel 87, the second flow channel 88, and the third flow channel 89 each extend in linear shapes. As a result, the nozzle unit 60 suppresses the reduction of the hole diameters (the flow channel areas) of the first and second flow channels 87 and 88 inside the nozzle main body 80. Accordingly, the nozzle unit 60 can stably discharge water from the nozzle head 85.

The draft angles of the first, second, and third flow channels 87, 88, and 89 are about 1° to 5°. Due to the draft angles, the hole diameter at the boundary between the first flow channel 87 and the second flow channel 88 is less than the hole diameter at the case 73 side of the first flow channel 87 and the hole diameter at the nozzle head 85 side of the second flow channel 88.

Even if the hole diameter at the boundary between the first flow channel 87 and the second flow channel 88 is narrower, the flow rate of the water or functional water (hereinbelow, referred to as water) flowing through the first to third flow channels 87 to 89 can be uniform because the hole diameter at the nozzle head 85 side of the second flow channel 88 is large. As a result, the pressure loss of the water flowing through the first to third flow channels 87 to 89 can be reduced, and so a stable water discharge from the nozzle head 85 is possible.

The water flow direction of the second flow channel 88 is different from the water flow direction of the first flow channel 87 in the longitudinal direction of the nozzle unit 60. Also, the water flow direction of the third flow channel 89 is different from the water flow directions of the first and second flow channels 87 and 88 in the longitudinal direction of the nozzle unit 60. In other words, the boundary between the first flow channel 87 and the second flow channel 88 and the boundary between the second flow channel 88 and the third flow channel 89 each are change points at which the water flow direction changes. In other words, the flow direction of the water flowing through the nozzle unit 60 changes in stages at the first to third flow channels 87 to 89.

As shown in FIG. 10, an angle $\alpha 1$ between the first flow channel 87 and horizontal is less than an angle $\alpha 2$ between the second flow channel 88 and horizontal ($\alpha 1<\alpha 2$). In other words, the second flow channel 88 has a larger incline than the first flow channel 87. An angle $\alpha 3$ between the third flow channel 89 and horizontal is greater than the angle $\alpha 2$ between the second flow channel 88 and horizontal ($\alpha 1<\alpha 2<\alpha 3$). In other words, the incline of the nozzle main body 80 increases from the first flow channel 87 toward the third flow channel 89.

By increasing the incline angle gradually from the first flow channel 87 toward the third flow channel 89, the pressure loss of the water flowing through the first to third flow channels 87 to 89 can be suppressed. As a result, stable water discharge from the nozzle head 85 is possible.

A length L1 of the first cylindrical part 82, a length L2 of the second cylindrical part 83, and a length L3 of the nozzle head 85 may be equal. In such a case, "equal" includes the range of the manufacturing error of the first cylindrical part 82, the second cylindrical part 83, and the nozzle head 85. The range of the manufacturing error is, for example, within 0.1 mm to 2.0 mm. As a result, the change amount of the inclines of the first and second cylindrical parts 82 and 83 and the nozzle head 85 can be constant. Accordingly, the effects of the pressure loss due to connecting the first to third flow channels 87 to 89 can be suppressed; and more stable water discharge from the nozzle head 85 is possible.

The nozzle cover 90 covers the outer surfaces 82*a*, 83*a*, and 85*a* of the nozzle main body 80. As shown in FIG. 7, the nozzle cover 90 is curved to be upwardly convex, and advances and retreats along an arc-like trajectory. The nozzle cover 90 includes hole parts 90*a* that communicate respectively with the bottom wash water discharge port 85*b*, the gentle wash water discharge port 85*c*, and the bidet wash water discharge port 85*d*, and a notched part 90*b* that exposes the first spout hole 85*e* and the second spout hole 85*f*.

According to the embodiment, the nozzle unit 60 is curved to be upwardly convex, and advances and retreats along an arc-like trajectory. As a result, the height dimension of the private part washing device 30 can be as small as possible. Accordingly, the creativity of the sanitary washing device 100 can be improved because the height dimension of the casing 10 also can be as low as possible.

On the other hand, it may be considered to curve the flow channel inside the nozzle unit to match the curved shape of the nozzle unit. In such a case, for example, when the curve of the nozzle unit is large, there is a risk that the flow channel may undesirably taper due to the manufacturing error, and the flow channel area cannot be ensured. If the flow channel is to be made larger, it may be necessary to make the nozzle unit undesirably larger.

Therefore, the nozzle unit 60 includes the first flow channel 87 through which water flows, and the second flow channel 88 connected to the first flow channel 87. The water flow direction of the second flow channel 88 is different from the water flow direction of the first flow channel 87 in the longitudinal direction of the nozzle unit 60. In the nozzle unit 60, the first flow channel 87 and the second flow channel 88 change the water flow direction in stages, and so the flow channel area can be ensured, and the water discharge can be stable.

The first flow channel 87 and the second flow channel 88 each extend in linear shapes. As a result, the nozzle unit 60 can be efficiently manufactured because the mold pins can be easily removed from the first and second flow channels 87 and 88. The flow channel areas of the first and second flow channels 87 and 88 can be ensured, and so the water discharge can be stable even when the nozzle unit 60 has a curved shape.

The nozzle unit 60 includes the nozzle main body 80, and the nozzle cover 90 that covers the nozzle main body 80 and is curved to be upwardly convex. The nozzle main body 80 includes the first cylindrical part 82 that includes the first flow channel 87, and the second cylindrical part 83 that includes the second flow channel 88. An outer surface 82*a* of the first cylindrical part 82 and the outer surface 83*a* of the second cylindrical part 83 each extend in linear shapes in the longitudinal directions.

In other words, the first and second cylindrical parts 82 and 83 of which the outer surfaces 82*a* and 83*a* have linear shapes in the longitudinal directions are stored inside the curved nozzle cover 90. As a result, for example, even when the first cylindrical part 82 and the second cylindrical part 83 are curved, constant wall thicknesses can be ensured between the first and second flow channels 87 and 88 and the outer surfaces 82*a* and 83*a* of the first and second cylindrical parts 82 and 83. Therefore, the water discharge can be stable while guaranteeing the durability of the nozzle main body 80.

The second cylindrical part 83 is connected to the front of the first cylindrical part 82. Such a configuration can improve the durability of the nozzle main body 80 compared to, for example, a multistage nozzle unit in which the second cylindrical part advances to protrude from the interior of the first cylindrical part.

The angle $\alpha 1$ between the first flow channel 87 and horizontal is less than the angle $\alpha 2$ between the second flow channel 88 and horizontal. As a result, the first and second cylindrical parts 82 and 83 in which the first and second flow channels 87 and 88 are made can be formed to extend along the nozzle cover 90, which is curved to be upwardly convex, while maintaining constant wall thicknesses. Therefore, compared to when the first and second flow channels 87 and 88 are curved upward, physical interference between the nozzle cover 90 and the first and second cylindrical parts 82 and 83 can be suppressed, and the nozzle main body 80 can be compact.

The nozzle main body 80 also includes the nozzle head 85 that is connected to the front of the second cylindrical part 83 and includes the third flow channel 89. The angle $\alpha 3$ between the third flow channel 89 and horizontal is greater than the angle $\alpha 2$ between the second flow channel 88 and horizontal. As a result, the nozzle main body 80 can be easily stored in the nozzle cover 90 because the nozzle main body 80 can be more compact.

The length L1 of the first cylindrical part 82, the length L2 of the second cylindrical part 83, and the length L3 of the nozzle head 85 are equal. As a result, the change amount of the inclination angles of the first cylindrical part 82, the second cylindrical part 83, and the nozzle head 85 can be constant. Accordingly, the effects of the pressure loss caused by connecting multiple flow channels can be suppressed, and the water discharge can be more stable.

An example is described in the embodiment above in which the water flow direction has two stages due to the nozzle main body 80 including the first cylindrical part 82 that includes the first flow channel 87 and the second cylindrical part 83 that includes the second flow channel 88. However, aspects of the invention are not limited thereto; for example, the nozzle main body may include three or more cylindrical parts (flow channels) in which the water flow directions are different in stages.

An example is described in the embodiment above in which the first flow channel 87 and the second flow channel 88 are linear flow channels. However, aspects of the invention are not limited thereto; for example, at least one of the first flow channel 87 or the second flow channel 88 may be a curved flow channel, or both flow channels may be curved flow channels. In other words, the flow channels inside the nozzle main body 80 may be only straight flow channels, only curved flow channels, or both straight flow channels and curved flow channels.

The bonding state between the cylindrical part 81 (the second cylindrical part 83) and the nozzle head 85 will now be described with reference to FIGS. 11 to 14.

Figure 11:
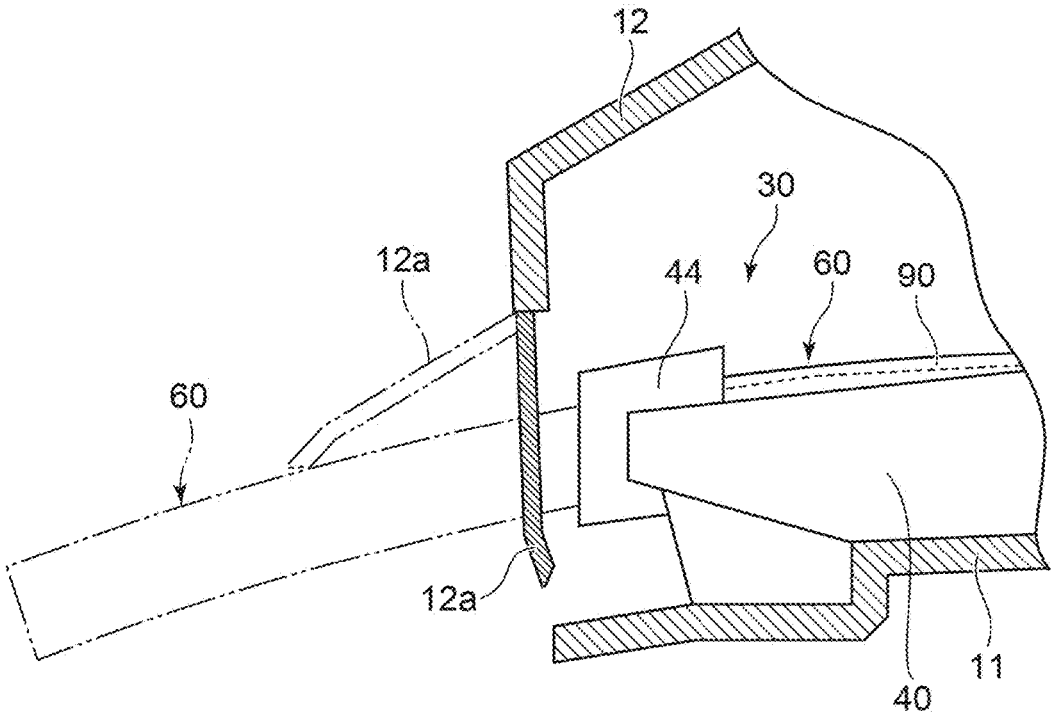
FIG. 11 is a cross-sectional view of the private part washing device inside the casing when viewed laterally.

FIG. 11 is a cross-sectional view of the private part washing device inside the casing when viewed laterally.

Figure 12:
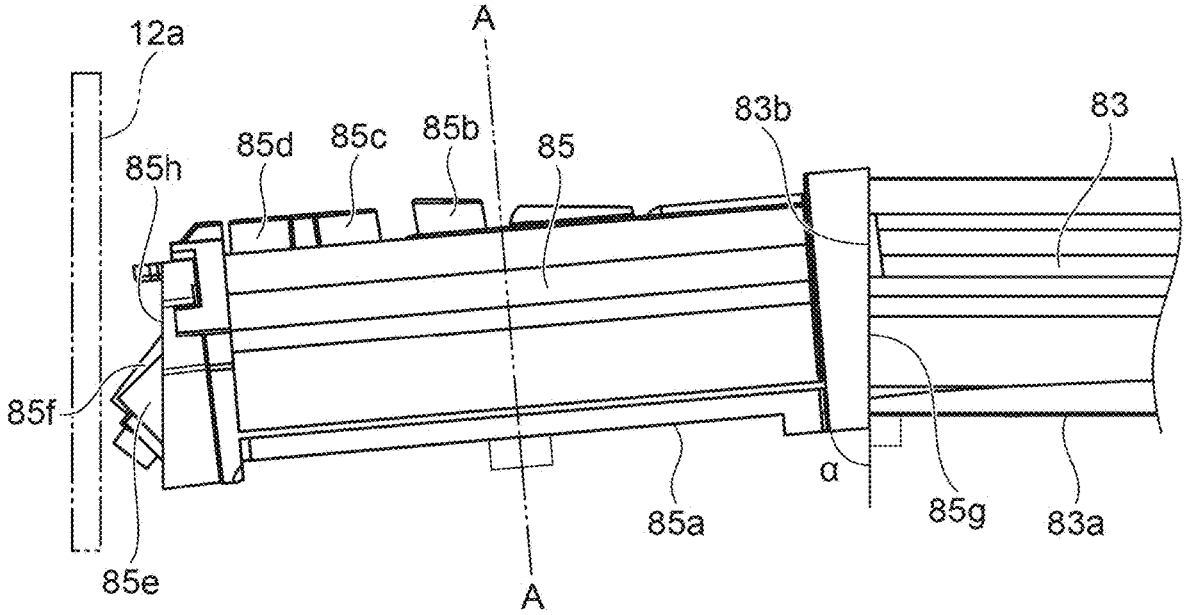
FIG. 12 is an enlarged side view showing the cylindrical part and the nozzle head.

FIG. 12 is an enlarged side view showing the cylindrical part and the nozzle head.

Figure 13:
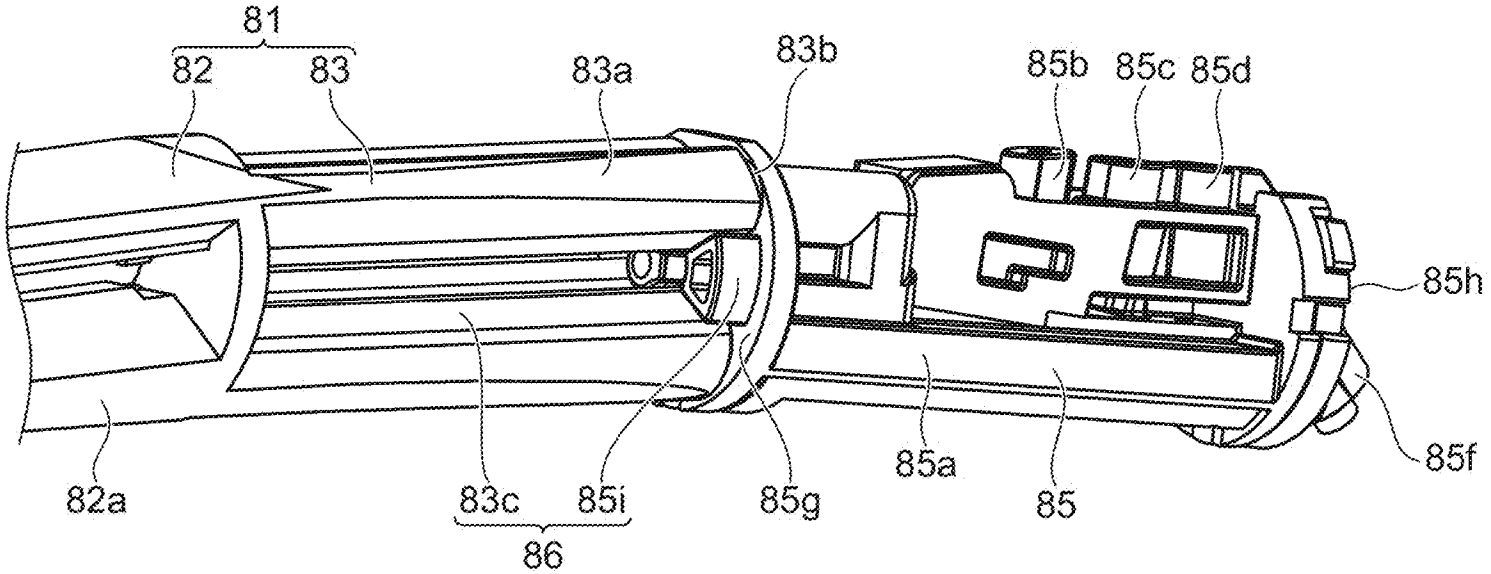
FIG. 13 is a perspective view of the contact portion between the cylindrical part and the nozzle head when viewed from obliquely behind.

FIG. 13 is a perspective view of the contact portion between the cylindrical part and the nozzle head when viewed from obliquely behind.

Figure 14:
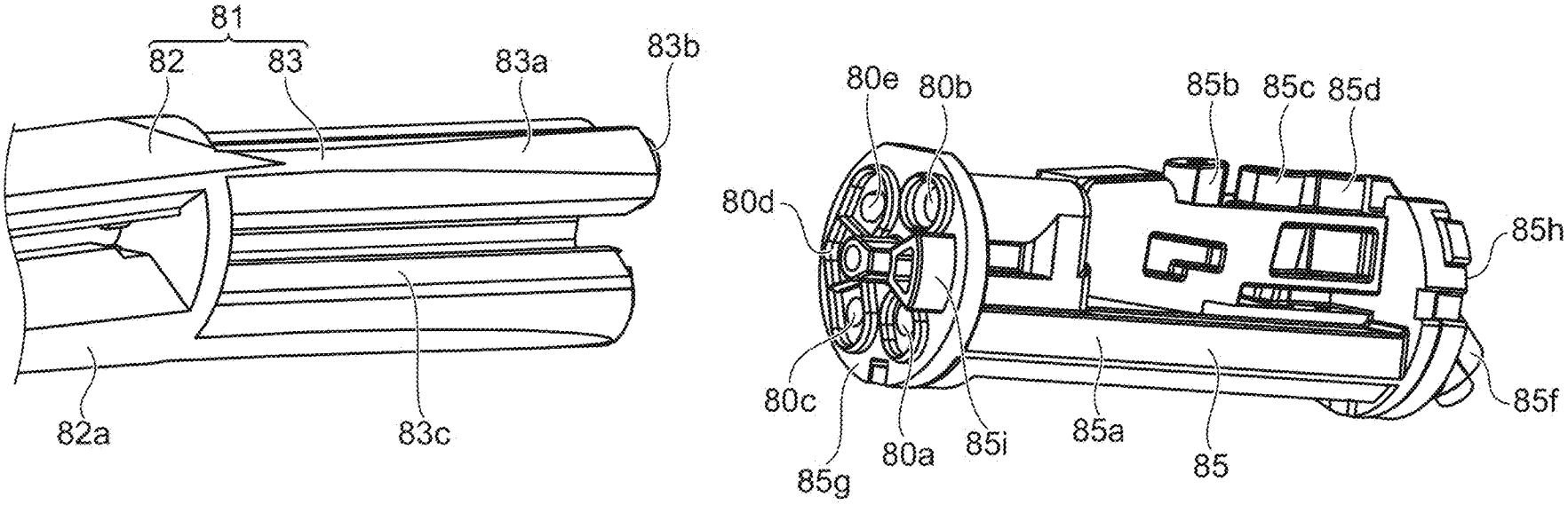
FIG. 14 is an exploded perspective view showing a state in which the nozzle head of FIG. 13 is detached from the cylindrical part.

FIG. 14 is an exploded perspective view showing a state in which the nozzle head of FIG. 13 is detached from the cylindrical part.

When the nozzle unit 60 is curved to be able to advance and retreat along an arc-like trajectory, there is a risk that the advance distance of the nozzle unit 60 must be short, and it may be difficult to adjust the water discharge point. In other words, when the advance distance into the toilet 200 of the nozzle unit 60 is short, there is a risk that the bottom wash water discharge port 85*b*, the gentle wash water discharge port 85*c*, and the bidet wash water discharge port 85*d* may discharge the water from behind the private part of the user.

Therefore, the nozzle head 85 is mounted to the second cylindrical part 83 to extend to be bent from the front surface part 83*b* of the cylindrical part 81 (the second cylindrical part 83). Specifically, the nozzle head 85 extends to be bent obliquely downward from the front surface part 83*b* of the second cylindrical part 83.

As shown in FIG. 12, the front surface part 83*b* of the second cylindrical part 83 extends perpendicularly to the longitudinal direction of the second cylindrical part 83. The back surface part 85*g* of the nozzle head 85 is inclined with respect to a perpendicular plane A-A, which is in the vertical direction with respect to the longitudinal direction of the nozzle head 85. The perpendicular plane A-A is a transverse cross section of the nozzle head 85. In other words, when the nozzle head 85 is in the horizontal state, the upper end of the back surface part 85*g* protrudes further backward (toward the second cylindrical part 83 side) than the lower end of the back surface part 85*g*.

In other words, an angle $\alpha$ between the outer surface 85*a* and the back surface part 85*g* of the nozzle head 85 is less than 90°. The angle $\alpha$ that is formed is set based on the advance distance into the toilet 200 of the nozzle unit 60, the positions of the bottom wash water discharge port 85*b*, the gentle wash water discharge port 85*c*, and the bidet wash water discharge port 85*d*, etc. The openings (the water discharge directions) of the bottom wash water discharge port 85*b*, the gentle wash water discharge port 85*c*, and the bidet wash water discharge port 85*d* can be directed frontward by reducing the angle $\alpha$.

Thus, the openings of the bottom wash water discharge port 85*b*, the gentle wash water discharge port 85*c*, and the bidet wash water discharge port 85*d* can be directed frontward by tilting the nozzle head 85 downward. Accordingly, the nozzle unit 60 can efficiently discharge water toward the private part of the user even when the advance distance into the toilet 200 is short.

Also, the tip surface part 85*h* of the nozzle head 85 is inclined in the same direction as the back surface part 85*g* with respect to the perpendicular plane A-A, which is perpendicular to the longitudinal direction of the nozzle head 85. In the example, the tip surface part 85*h* extends parallel to the back surface part 85*g*. As shown in FIG. 12, the tip surface part 85*h* extends parallel to the lid part 12*a* in the state in which the nozzle unit 60 is stored inside the casing 10. As a result, in the state in which the nozzle unit 60 is stored inside the casing 10, the nozzle unit 60 can approach the lid part 12*a* as much as possible. Accordingly, a compact sanitary washing device 100 can be provided.

As shown in FIGS. 13 and 14, the second cylindrical part 83 and the nozzle head 85 include a positioning part 86 for fixing the position of the nozzle head 85 with respect to the second cylindrical part 83. The positioning part 86 includes a recess 83*c* disposed in the second cylindrical part 83, and a protrusion 85*i* that is disposed in the nozzle head 85 and inserted into the recess 83*c*.

The recess 83*c* extends backward (toward the first cylindrical part 82 side) from the front surface part 83*b* of the second cylindrical part 83. The recess 83*c* is disposed between the flow channels 80*a* to 80*e* inside the second cylindrical part 83. The protrusion 85*i* is positioned between the flow channels 80*a* to 80*e* of the nozzle head 85 and protrudes backward from the back surface part 85*g*. For example, the protrusion 85*i* is configured to fit into the recess 83*c*.

When the nozzle head 85 is adhered to the second cylindrical part 83, the second cylindrical part 83 and the nozzle head 85 are positioned by press-fitting the protrusion 85*i* into the recess 83*c*. The second cylindrical part 83 and the nozzle head 85 can have a continuous body by adhering the front surface part 83*b* of the second cylindrical part 83 and the back surface part 85*g* of the nozzle head 85 in this state.

The positioning part 86 suppresses misconnections between the flow channels 80*a* to 80*e* of the second cylindrical part 83 and the flow channels 80*a* to 80*e* of the nozzle head 85. A sufficient fitting overlap can be ensured by the recess 83*c* extending in the longitudinal direction from the front surface part 83*b*, which is a surface perpendicular to the longitudinal direction. The positioning part 86 may be disposed with the recess 83*c* and the protrusion 85*i* reversed. In other words, the positioning part 86 may include a protrusion disposed in the second cylindrical part 83, and a recess that is disposed in the nozzle head 85 and into which the protrusion is inserted.

The nozzle cover 90 covers the outer surfaces 82*a*, 83*a*, and 85*a* of the nozzle main body 80. As shown in FIG. 7, the nozzle cover 90 is curved to be upwardly convex. As shown in FIGS. 7 and 8, the first cylindrical part 82, the second cylindrical part 83, and the nozzle head 85 extend inside the nozzle cover 90 to be bent downward in stages. The second cylindrical part 83 may not be bent with respect to the first cylindrical part 82.

The nozzle cover 90 includes the notched part 90*b* that exposes the hole part 90*a*, the first spout hole 85*e*, and the second spout hole 85*f* that respectively communicate with the bottom wash water discharge port 85*b*, the gentle wash water discharge port 85*c*, and the bidet wash water discharge port 85*d*. The front surface part of the nozzle cover 90 extends parallel to the tip surface part 85*h* to match the tip surface part 85*h* of the nozzle head 85.

A nozzle unit according to a second embodiment will now be described with reference to FIG. 15.

Figure 15:
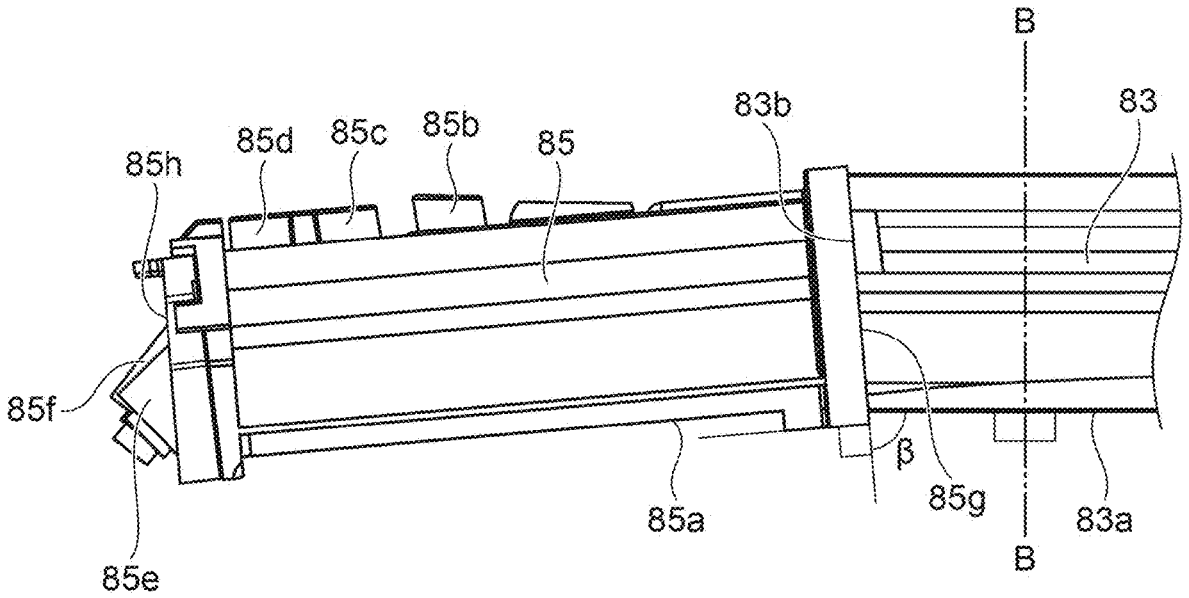
FIG. 15 is a side view showing a cylindrical part and a nozzle head of a sanitary washing device according to the second embodiment.

FIG. 15 is a side view showing a cylindrical part and a nozzle head of a sanitary washing device according to the second embodiment.

An example is described in the first embodiment in which the front surface part 83*b* of the second cylindrical part 83 is perpendicular to the longitudinal direction of the second cylindrical part 83. However, aspects of the invention are not limited thereto; for example, as in the second embodiment shown in FIG. 15, the back surface part 85*g* of the nozzle head 85 may be perpendicular to the longitudinal direction of the nozzle head 85. In such a case, the front surface part 83*b* of the cylindrical part 81 (the second cylindrical part 83) is inclined with respect to a perpendicular plane B-B, which is in the vertical direction with respect to the longitudinal direction of the second cylindrical part 83. In other words, when the second cylindrical part 83 is in the horizontal state, the upper end of the front surface part 83*b* protrudes further frontward (toward the nozzle head 85 side) than the lower end of the front surface part 83*b*. In other words, an angle β between the outer surface 83*a* and the front surface part 83*b* of the second cylindrical part 83 is less than 90°. According to such an aspect, the nozzle head 85 may extend to be bent from the front surface part 83*b* of the cylindrical part 81.

A nozzle unit according to a third embodiment will now be described with reference to FIG. 16.

Figure 16:
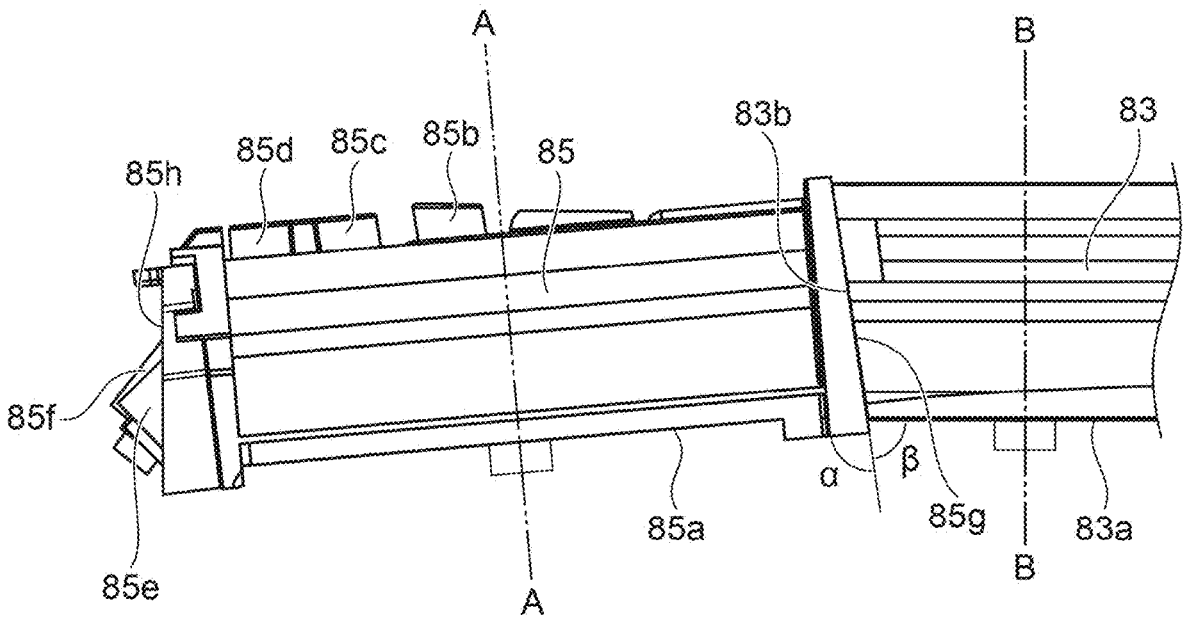
FIG. 16 is a side view showing a cylindrical part and a nozzle head of a sanitary washing device according to the third embodiment.

FIG. 16 is a side view showing a cylindrical part and a nozzle head of a sanitary washing device according to the third embodiment.

An example is described in the first embodiment in which the front surface part 83*b* of the second cylindrical part 83 is perpendicular to the longitudinal direction of the second cylindrical part 83. An example is described in the second embodiment in which the back surface part 85*g* of the nozzle head 85 is perpendicular to the longitudinal direction of the nozzle head 85. However, aspects of the invention are not limited thereto; for example, as in the third embodiment shown in FIG. 16, the front surface part 83*b* of the second cylindrical part 83 may not be perpendicular to the longitudinal direction of the second cylindrical part 83; and the back surface part 85*g* of the nozzle head 85 may not be perpendicular to the longitudinal direction of the nozzle head 85.

In such a case, the back surface part 85*g* of the nozzle head 85 is inclined with respect to the perpendicular plane A-A, which is in the vertical direction with respect to the longitudinal direction of the nozzle head 85. Also, the front surface part 83*b* of the cylindrical part 81 (the second cylindrical part 83) is inclined with respect to the perpendicular plane B-B, which is in the vertical direction with respect to the longitudinal direction of the second cylindrical part 83. In other words, the angle α between the outer surface 85*a* and the back surface part 85*g* of the nozzle head 85 is greater than 90°. The angle β between the outer surface 83*a* and the front surface part 83*b* of the second cylindrical part 83 is less than 90°. According to such an aspect, the nozzle head 85 may extend to be bent from the front surface part 83*b* of the cylindrical part 81.

Embodiments may include the following configurations.

Configuration 1

A sanitary washing device, comprising:

a casing; and a nozzle unit configured to advance and retreat between the casing and a toilet, the nozzle unit being curved to be upwardly convex, and being configured to advance and retreat along an arc-like trajectory, the nozzle unit including a first flow channel through which water flows, and a second flow channel connected to the first flow channel, a water flow direction of the second flow channel in a longitudinal direction of the nozzle unit being different from a water flow direction of the first flow channel in the longitudinal direction.

Configuration 2

The device according to configuration 1, wherein the first flow channel and the second flow channel each extend in linear shapes.

Configuration 3

The device according to configuration 1 or 2, wherein the nozzle unit includes:

a nozzle main body; and a nozzle cover covering the nozzle main body, the nozzle cover being curved to be upwardly convex, the nozzle main body includes:

a first cylindrical part including the first flow channel; and a second cylindrical part including the second flow channel, an outer surface of the first cylindrical part extends in a linear shape in a longitudinal direction of the first cylindrical part, and and an outer surface of the second cylindrical part extends in a linear shape in a longitudinal direction of the second cylindrical part.

Configuration 4

The device according to configuration 3, wherein the second cylindrical part is connected to a front of the first cylindrical part.

Configuration 5

The device according to any one of configurations 1 to 4, wherein an angle between the first flow channel and horizontal is less than an angle between the second flow channel and horizontal.

Configuration 6

The device according to configuration 5, wherein the nozzle unit includes:

a first cylindrical part including the first flow channel;

a second cylindrical part including the second flow channel; and a nozzle head connected to a front of the second cylindrical part, the nozzle head including a third flow channel, an angle between the third flow channel and horizontal being greater than the angle between the second flow channel and horizontal.

Configuration 7

The device according to configuration 6, wherein a length of the first cylindrical part, a length of the second cylindrical part, and a length of the nozzle head are equal.

Configuration 8

The device according to configuration 1, wherein the nozzle unit includes:

a cylindrical part;

a nozzle head connected to a front surface part of the cylindrical part; and a nozzle cover covering the cylindrical part and the nozzle head, the nozzle cover is curved to be upwardly convex, and the nozzle head extends to be bent from the front surface part of the cylindrical part.

Configuration 9

The device according to configuration 8, wherein the front surface part of the cylindrical part is perpendicular to a longitudinal direction of the cylindrical part.

Configuration 10

The device according to configuration 8, wherein the nozzle head includes:

a back surface part connected to the front surface part of the cylindrical part; and a tip surface part facing the back surface part in the longitudinal direction of the nozzle head, the tip surface part is inclined in a same direction as the back surface part with respect to a perpendicular plane, and the perpendicular plane is perpendicular to the longitudinal direction of the nozzle head.

Configuration 11

The device according to any one of configurations 8 to 10, wherein the cylindrical part and the nozzle head include a positioning part for fixing a position of the nozzle head with respect to the cylindrical part.

Configuration 12

The device according to configuration 11, wherein the positioning part includes:

a recess disposed in the cylindrical part; and a protrusion disposed in the nozzle head, and the protrusion is inserted into the recess.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the sanitary washing device is not limited to the illustration and can be appropriately modified. The components included in the embodiments described above may be combined within the extent of technical feasibility, and any combinations of these components also are included in the scope of the invention to the extent that they include the feature of the invention.

What is claimed is:

1. A sanitary washing device, comprising:

a casing; and a nozzle unit configured to advance and retreat between the casing and a toilet, the nozzle unit being curved upwardly convex, and being configured to advance and retreat along an arc shaped trajectory, the nozzle unit including a first flow channel through which water flows, and a second flow channel connected to the first flow channel, a water flow direction of the second flow channel in a longitudinal direction of the nozzle unit being different from a water flow direction of the first flow channel in the longitudinal direction, wherein the first flow channel and the second flow channel each extend in linear shapes, and a boundary between the first flow channel and the second flow channel is a change point at which the water flow direction changes.

2. The device according to claim 1, wherein the nozzle unit includes:

a nozzle main body; and a nozzle cover covering the nozzle main body, the nozzle cover being curved to be upwardly convex, the nozzle main body includes:

a first cylindrical part including the first flow channel; and a second cylindrical part including the second flow channel, an outer surface of the first cylindrical part extends in a linear shape in a longitudinal direction of the first cylindrical part, and and an outer surface of the second cylindrical part extends in a linear shape in a longitudinal direction of the second cylindrical part.

3. The device according to claim 2, wherein the second cylindrical part is connected to a front of the first cylindrical part.

4. The device according to claim 1, wherein an angle between the first flow channel and horizontal is less than an angle between the second flow channel and horizontal.

5. The device according to claim 4, wherein the nozzle unit includes:

a first cylindrical part including the first flow channel;

a second cylindrical part including the second flow channel; and a nozzle head connected to a front of the second cylindrical part, the nozzle head including a third flow channel, an angle between the third flow channel and horizontal being greater than the angle between the second flow channel and horizontal.

6. The device according to claim 5, wherein a length of the first cylindrical part, a length of the second cylindrical part, and a length of the nozzle head are equal.

7. The device according to claim 1, wherein the nozzle unit includes:

a cylindrical part;

a nozzle head connected to a front surface part of the cylindrical part; and a nozzle cover covering the cylindrical part and the nozzle head, the nozzle cover is curved upwardly convex, and the nozzle head extends bent from the front surface part of the cylindrical part.

8. The device according to claim 7, wherein the front surface part of the cylindrical part is perpendicular to a longitudinal direction of the cylindrical part.

9. The device according to claim 7, wherein the nozzle head includes:

a back surface part connected to the front surface part of the cylindrical part; and a tip surface part facing the back surface part in the longitudinal direction of the nozzle head, the tip surface part is inclined in a same direction as the back surface part with respect to a perpendicular plane, and the perpendicular plane is perpendicular to the longitudinal direction of the nozzle head.

10. The device according to claim 7, wherein the cylindrical part and the nozzle head include a positioning part for fixing a position of the nozzle head with respect to the cylindrical part.

11. The device according to claim 10, wherein the positioning part includes:

a recess disposed in the cylindrical part; and a protrusion disposed in the nozzle head, and the protrusion is inserted into the recess.

12. A sanitary washing device, comprising:

a casing; and a nozzle unit configured to advance and retreat between the casing and a toilet, the nozzle unit being curved upwardly convex, and being configured to advance and retreat along an arc-shaped trajectory, the nozzle unit including a first flow channel through which water flows, and a second flow channel connected to the first flow channel, wherein the nozzle unit includes:

a first cylindrical part including the first flow channel;

a second cylindrical part including the second flow channel; and a nozzle head connected to a front of the second cylindrical part, the nozzle head including a third flow channel, a water flow direction of the second flow channel in a longitudinal direction of the nozzle unit being different from a water flow direction of the first flow channel in the longitudinal direction, wherein the first flow channel and the second flow channel each extend in linear shapes, and an angle between the first flow channel and horizontal is less than an angle between the second flow channel and horizontal.

* * * * *